US011280515B2

(12) United States Patent
Branham

(10) Patent No.: US 11,280,515 B2
(45) Date of Patent: Mar. 22, 2022

(54) VENTILATION FAN TRIM RING MOUNTING ASSEMBLY

(71) Applicant: Ascent Products, LLC, Gig Harbor, WA (US)

(72) Inventor: Tony J. Branham, Gig Harbor, WA (US)

(73) Assignee: Ascent Holdings, LLC, Gig Harbor, WA (US)

( * ) Notice: Subject to any disclaimer, the term of this patent is extended or adjusted under 35 U.S.C. 154(b) by 91 days.

(21) Appl. No.: 16/403,164

(22) Filed: May 3, 2019

(65) Prior Publication Data

US 2020/0217552 A1 Jul. 9, 2020

Related U.S. Application Data

(63) Continuation-in-part of application No. 16/243,666, filed on Jan. 9, 2019, now Pat. No. 11,015,822.

(51) Int. Cl.
*F24F 13/02* (2006.01)
*F24F 13/078* (2006.01)
(Continued)

(52) U.S. Cl.
CPC ..... *F24F 13/02* (2013.01); *F24F 13/078* (2013.01); *F24F 13/20* (2013.01); *F21S 8/02* (2013.01); *F21S 8/026* (2013.01); *F24F 7/007* (2013.01); *F24F 2013/205* (2013.01); *F24F 2221/14* (2013.01)

(58) Field of Classification Search
CPC ..... F21S 8/026; F21S 8/02; F21S 8/04; F21S 8/024; F21V 17/164; F21V 21/04; F21V 33/0088; F24F 13/02; F24F 13/20; F24F 2013/205; F24F 13/078; H02G 3/22
See application file for complete search history.

(56) References Cited

U.S. PATENT DOCUMENTS 2,899,542 A * 8/1959 De Mauro ..... F21S 8/02 362/364
2,961,115 A 11/1960 Aylor
(Continued)

OTHER PUBLICATIONS

U.S. Appl. No. 15/799,078, filed Oct. 31, 2017, Ventilation Fan Housing and Mounting System.

*Primary Examiner* — Jonathan Liu
*Assistant Examiner* — Taylor L Morris
(74) *Attorney, Agent, or Firm* — Seed Intellectual Property Law Group LLP

(57) ABSTRACT

A system for mounting an object in an opening in a structural member that has opposing first and second surfaces, the system including a housing with an interior to house the object and receivable within the opening in the structural member, the housing having at least one bendable tab to bear against and support the housing on the first surface of the structural member, the housing further including at least one pair of openings, and a trim ring having an interior side and an opposing exterior side, the interior side having one tab shaped to engage an opening in the pair of openings, the trim ring further including at least a second tab sized and shaped to engage an opening in a second pair of openings in the housing and thereby hold the trim ring in place on the housing while bearing against the second surface of the structural member.

5 Claims, 22 Drawing Sheets

(51) Int. Cl.

| | |
|---|---|
| ***F24F 13/20*** | (2006.01) |
| *F21S 8/02* | (2006.01) |
| *F24F 7/007* | (2006.01) |

(56) References Cited

U.S. PATENT DOCUMENTS 2,963,783 A 12/1960 Field
3,286,090 A * 11/1966 Brown ..... F21S 8/02 362/366
3,420,995 A * 1/1969 Dunckel ..... F21V 21/04 362/366
3,590,241 A * 6/1971 Docimo ..... F21S 8/02 362/355
3,697,742 A * 10/1972 Bobrick ..... F21S 8/02 362/366
3,720,432 A * 3/1973 Chudler ..... E04B 9/003 292/220
4,009,894 A 3/1977 Marquette et al.
4,294,476 A 10/1981 Nash
4,491,124 A 1/1985 Goettel
4,550,648 A 11/1985 Eagle
5,044,987 A 9/1991 Tihanyi
5,152,117 A 10/1992 Wynar
5,161,573 A * 11/1992 Krupp ..... F16K 17/0413 137/526
5,211,580 A 5/1993 Schuplin
5,314,212 A 5/1994 Sanders
5,393,106 A 2/1995 Schroeder
5,475,577 A * 12/1995 Vanderhoof ..... F21V 21/04 248/27.1
5,518,277 A 5/1996 Sanders
5,537,714 A * 7/1996 Lynch, Jr. ..... B60R 16/0222 16/2.1
5,538,293 A 7/1996 Kolt
5,746,507 A * 5/1998 Lee ..... F21V 21/04 362/147
5,799,446 A 9/1998 Tamlyn
5,820,247 A * 10/1998 Schuler ..... F21V 3/02 362/96
5,934,783 A * 8/1999 Yoshikawa ..... F21V 33/0096 362/96
5,951,151 A * 9/1999 Doubeck ..... F21V 21/04 362/365
5,957,506 A 9/1999 Stepp
5,957,572 A * 9/1999 Wedekind ..... F21V 21/04 362/365
6,000,818 A * 12/1999 Caluori ..... F21V 21/04 362/147
6,095,671 A * 8/2000 Hutain ..... F21V 29/507 362/373
6,149,280 A * 11/2000 Quiogue ..... F21S 8/02 362/147
6,261,175 B1 * 7/2001 Larson ..... F24F 7/007 415/204
6,350,046 B1 * 2/2002 Lau ..... F21V 29/76 362/364
6,371,630 B1 * 4/2002 Unger ..... F21V 21/02 362/148
6,452,336 B1 * 9/2002 Dandu ..... F21S 8/02 315/56
6,488,579 B2 12/2002 Larson et al.
6,585,389 B2 * 7/2003 Bonazzi ..... F21S 8/02 362/147
6,595,664 B2 * 7/2003 Bucher ..... F21V 21/03 248/342
6,632,006 B1 * 10/2003 Rippel ..... F21S 8/02 362/147
6,957,896 B2 * 10/2005 Burgess ..... F21V 21/04 362/147
6,969,181 B1 * 11/2005 Bailey ..... F21S 2/00 362/147
6,979,169 B2 * 12/2005 Penlesky ..... F04D 29/4226 415/1
7,011,578 B1 3/2006 Core
7,186,008 B2 * 3/2007 Patti ..... F21S 8/02 362/147
7,203,416 B2 * 4/2007 Craw ..... F24H 3/0411 392/350
7,607,807 B2 * 10/2009 Hall ..... B60Q 3/51 296/215
7,614,769 B2 * 11/2009 Sell ..... F21S 8/026 362/147
7,625,105 B1 * 12/2009 Johnson ..... F21S 8/02 362/147
7,722,208 B1 * 5/2010 Dupre ..... F21S 8/02 362/147
7,748,868 B2 * 7/2010 Patti ..... F21V 21/14 362/269
7,784,979 B2 * 8/2010 Wronski ..... F21S 8/02 362/364
7,828,465 B2 * 11/2010 Roberge ..... H05B 45/3725 362/294
7,909,487 B1 * 3/2011 Venetucci ..... F21V 17/164 362/364
7,967,480 B2 * 6/2011 Pickard ..... F21V 21/048 362/362
7,980,735 B1 * 7/2011 Wronski ..... F21V 21/04 362/364
7,987,649 B1 8/2011 Polston
8,096,670 B2 * 1/2012 Trott ..... F21V 3/00 362/147
8,297,798 B1 * 10/2012 Pittman ..... F21V 7/28 362/296.05
8,382,332 B2 * 2/2013 Zakula ..... F21V 23/0464 362/294
8,382,340 B2 * 2/2013 Boyer ..... F21V 15/01 362/368
8,388,166 B2 * 3/2013 Rooms ..... F21S 8/04 362/147
8,486,525 B2 7/2013 Segur
8,511,867 B1 * 8/2013 Tam ..... E04F 13/06 362/366
8,523,383 B1 * 9/2013 Grigore ..... F21S 8/026 362/221
8,899,374 B2 * 12/2014 Tanaka ..... H04R 1/026 181/150
8,950,898 B2 * 2/2015 Catalano ..... F21V 21/04 362/249.02
8,967,832 B2 * 3/2015 Zakula ..... F21V 33/0088 362/294
8,985,364 B2 3/2015 Gagne et al.
9,046,257 B2 * 6/2015 Burguburu ..... F21V 21/096
9,134,014 B2 * 9/2015 Lyu ..... F21V 21/04
9,222,266 B1 12/2015 Conboy
9,344,787 B2 * 5/2016 Berkman ..... H04R 1/028
9,416,989 B1 * 8/2016 Tom ..... F24F 13/078
9,609,407 B2 * 3/2017 Berkman ..... H04R 1/021
9,631,789 B2 * 4/2017 White ..... F21V 23/003
9,709,253 B2 * 7/2017 Tickner ..... F21S 8/026
9,726,354 B1 * 8/2017 Delano ..... F21V 21/14
9,739,455 B2 * 8/2017 Rodriguez ..... F21V 21/046
10,041,654 B1 * 8/2018 Ernst ..... F21V 17/02
10,060,617 B2 * 8/2018 Horng ..... F24F 13/078
10,082,259 B1 * 9/2018 Pahl ..... F21S 8/026
10,125,958 B1 * 11/2018 Wronski ..... F21S 8/026
10,352,584 B2 * 7/2019 Huang ..... F24F 7/007
10,371,371 B2 * 8/2019 Fang ..... F21S 8/04
10,378,738 B1 * 8/2019 Davis ..... F21V 21/042
10,415,804 B2 * 9/2019 Wronski ..... F21V 21/096
10,429,039 B1 * 10/2019 Paulsel ..... F21V 17/105
2002/0172047 A1 * 11/2002 Ashley ..... F21S 8/02 362/364
2003/0193811 A1 * 10/2003 Mullen ..... F21V 17/164 362/455
2005/0111972 A1 * 5/2005 Penlesky ..... F04D 29/626 415/206
2006/0221620 A1 * 10/2006 Thomas ..... F21S 8/026 362/364
2008/0112171 A1 * 5/2008 Patti ..... F21V 21/04 362/365

(56) References Cited

U.S. PATENT DOCUMENTS

2008/0137347 A1* 6/2008 Trott ..... F21V 17/02 362/311.06
2008/0180961 A1* 7/2008 Gibson ..... F21S 8/02 362/364
2008/0232116 A1* 9/2008 Kim ..... F21V 21/03 362/365
2008/0304269 A1* 12/2008 Pickard ..... F21V 21/048 362/365
2008/0318515 A1 12/2008 Yeung
2009/0004966 A1* 1/2009 Su ..... F24F 7/065 454/346
2009/0186572 A1 7/2009 Farrell
2010/0009621 A1* 1/2010 Hsieh ..... F24F 7/007 454/293
2010/0020551 A1* 1/2010 Kay ..... F21V 21/34 362/365
2010/0175399 A1* 7/2010 Choi ..... F24F 1/0007 62/186
2010/0190432 A1* 7/2010 Viggers ..... F24F 13/20 454/275
2011/0080746 A1* 4/2011 Patti ..... F21S 8/026 362/370
2012/0087128 A1* 4/2012 Zakula ..... F24F 13/00 362/249.02
2012/0140489 A1* 6/2012 Chung ..... F21V 29/506 362/368
2013/0083549 A1* 4/2013 Takahara ..... F21V 15/01 362/382
2013/0315731 A1* 11/2013 Yang ..... F04D 29/601 416/5
2014/0254177 A1* 9/2014 Danesh ..... F21S 8/026 362/363
2015/0159910 A1* 6/2015 Huang ..... F24F 13/28 415/121.2
2015/0345761 A1* 12/2015 Lawlor ..... F21V 21/14 362/364
2016/0108925 A1* 4/2016 Huang ..... F04D 29/602 415/121.3
2016/0201884 A1* 7/2016 Ramirez ..... F21V 23/006 362/147
2016/0230947 A1* 8/2016 Bilodeau ..... F21V 21/044
2016/0313021 A1* 10/2016 Nakamura ..... F24F 13/22
2016/0320007 A1* 11/2016 Araki ..... F21V 19/004
2016/0356524 A1* 12/2016 Yoshitake ..... F24F 13/20
2017/0059102 A1* 3/2017 Grant ..... F21V 21/047
2017/0115028 A1* 4/2017 Lee ..... F24F 13/222
2017/0184285 A1* 6/2017 Visser ..... F21V 21/047
2017/0307198 A1* 10/2017 Shah ..... F21V 5/04
2017/0314750 A1* 11/2017 Feldman ..... F21S 8/026
2017/0314770 A1* 11/2017 Pahl ..... F21S 8/026
2018/0017239 A1* 1/2018 Liu ..... F21V 23/001
2018/0127977 A1* 5/2018 Voellmecke, III ..... F24F 13/20
2018/0231239 A1* 8/2018 Fang ..... F21S 8/026
2020/0158122 A1* 5/2020 Huang ..... F21S 8/04

* cited by examiner

VENTILATION FAN TRIM RING MOUNTING ASSEMBLY

BACKGROUND

Technical Field

The present disclosure pertains to the mounting of objects within a structural member, such as a wall, ceiling, and the like and, more particularly, to a ceiling or wall exhaust fan mounting system employing trim rings for simplified and secure installation, effective movement of air and vapor, and the presentation of an appealing appearance that facilitates a reduced height and room-side installation.

Description of the Related Art

Installation of objects, such as fans, light fixtures, controls, and the like in the interior of a residence or business can be complex and time consuming. In addition to the task of forming the correct opening, the installer must adequately fasten the object to the structural support. This requires the use of the correct fasteners, tools, and proper technique, and it typically requires access to the back side of the surface, such as via an attic for ceiling mount locations. It is desirable to provide a housing and mounting system that enables the installer to mount the housing from the interior of the room or space and, thus, avoid having the installer access the back side of the structural member, such as entering an attic or crawl space to install the housing. It is also desirable to provide for mounting to the structural member without the use of fasteners or tools, to facilitate connection to existing or new ducting within a constrained space, and to accommodate different thicknesses of structural members.

BRIEF SUMMARY

The present disclosure is directed to a system for use in mounting an object in an opening in a structural member, the structural member having opposing first and second surfaces, the system including a housing that is sized and shaped to define an interior to house the object and that can be received within the opening in the structural member, the housing having at least one flange extending outward therefrom to bear against the first surface of the structural member and support the housing on the structural member, the housing further including at least one tab opening, and a trim ring having an interior side and an opposing exterior side, the interior side having at least one resilient tab sized and shaped to releasably engage the tab opening in the housing, the trim ring further including at least one second member sized and shaped to bear against the second surface of the structural member when the tab is engaged with the tab opening in the housing and thereby hold the trim ring in place on the housing while bearing against the second surface of the structural member.

In accordance with another aspect of the present disclosure, the system includes a cover having a panel sized and shaped to cover the trim ring, the cover having a connector that releasably connects the cover to the housing, the cover further including at least one standoff extending therefrom that is sized and shaped to bear against the trim ring to hold the trim ring in place.

In accordance with a further aspect of the present disclosure, the housing has at least one wall that circumscribes the interior of the housing, the at least one wall having an interior face and a distal end, wherein the trim ring includes a body with a central opening and a flange extending from the body that is sized and shaped to bear against the interior face of the at least one wall adjacent the distal end in slidable engagement with the housing and to have an interference fit with the housing.

In accordance with yet another aspect of the present disclosure, the body of the trim ring comprises a ledge that extends from and is substantially orthogonal to the flange and is sized and shaped to bear against the second surface of the structural member when the trim ring is mounted on the housing.

In accordance with still yet another aspect of the present disclosure, the at least one wall of the housing has at least two tab openings in vertical arrangement and that are sized and shaped to releasably engage with the tab on the trim ring to accommodate different thicknesses of the structural member.

In accordance with yet a further aspect of the present disclosure, an assembly for use in mounting an object in an opening in a structural member is provided. The structural member has opposing first and second surfaces, and the assembly includes a housing that is sized and shaped to define an interior to house the object and that can be received within the opening in the structural member, the housing having at least one wall with a distal end and at least two pairs of openings formed in the at least one wall, the first opening positioned at least partially between the second opening and the distal end of the at least one wall; and a trim ring sized and shaped to fit within the interior of the housing, the trim ring having at least two tabs, each tab having a terminal end with a lip extending from the terminal end that is sized and shaped to be received in either one of the first and second openings in a respective one of the at least two pairs of first and second openings. Ideally the lip has a convex distal surface and an opposing planar surface.

In accordance with another aspect of the present disclosure, a first tab extending from the at least one wall of the housing, the first tab sized and shaped to be bent to bear against the first surface of the structural member.

In accordance with still yet a further aspect of the present disclosure, the assembly includes a shield having a panel sized and shaped to cover the trim ring, the shield having a connector that releasably connects the shield to the housing, the shield further including at least one standoff extending therefrom that is sized and shaped to bear against the trim ring to hold the trim ring in place.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
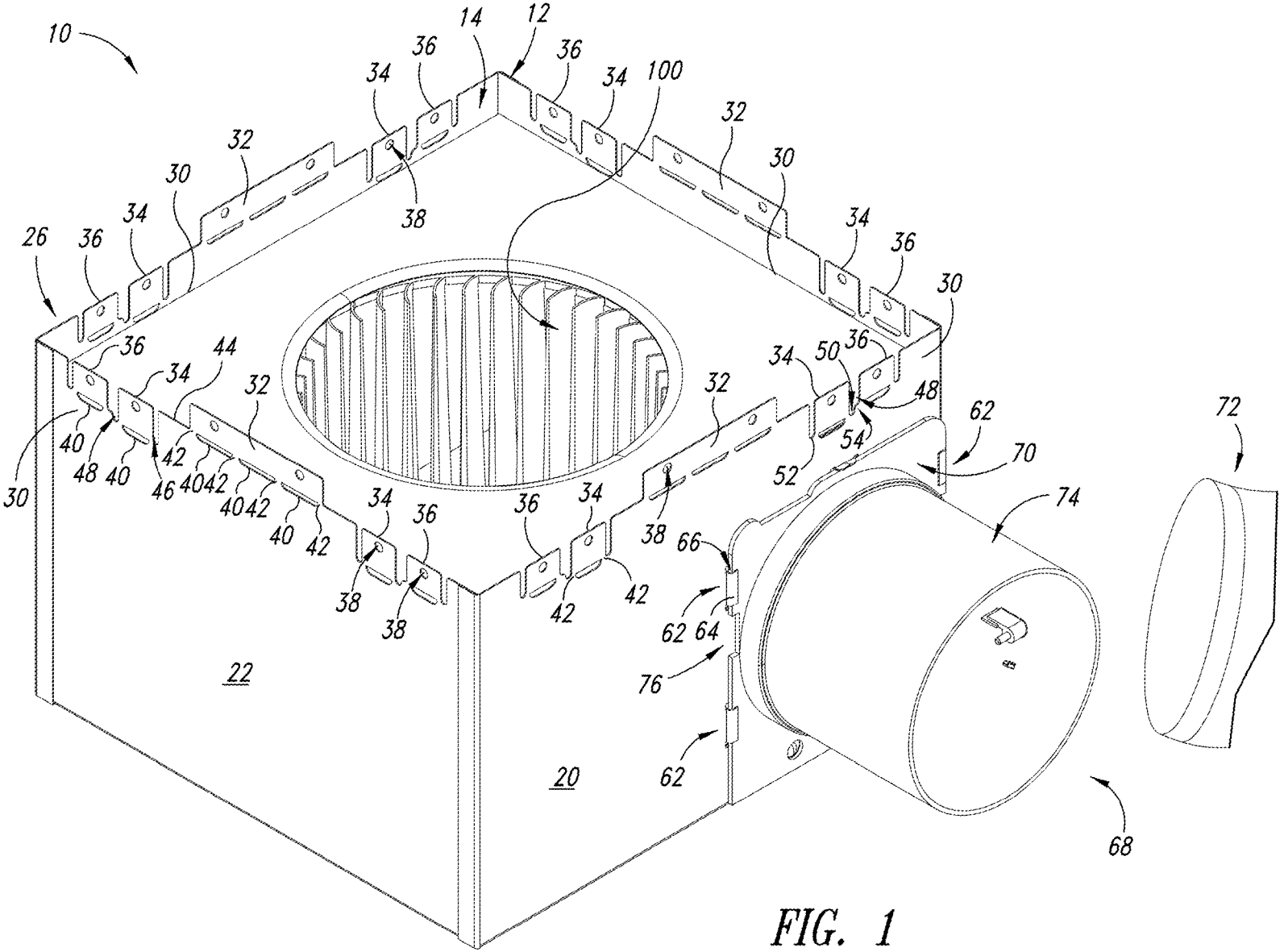
FIG. 1 is a bottom, right, front axonometric view of a fan housing formed in accordance with the present disclosure.
Figure 2:
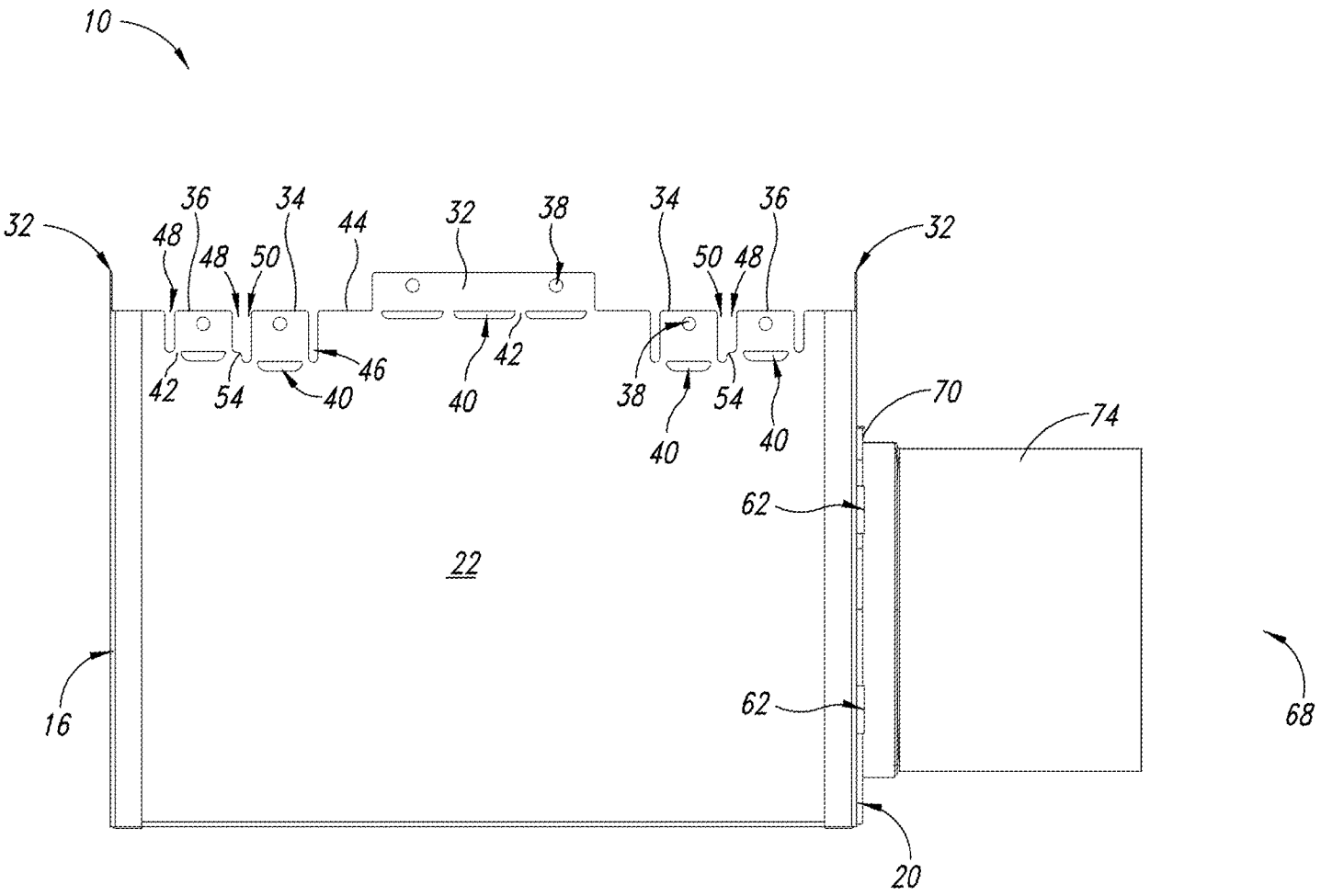
FIG. 2 is a right side elevational view of the fan housing of FIG. 1.
Figure 3:
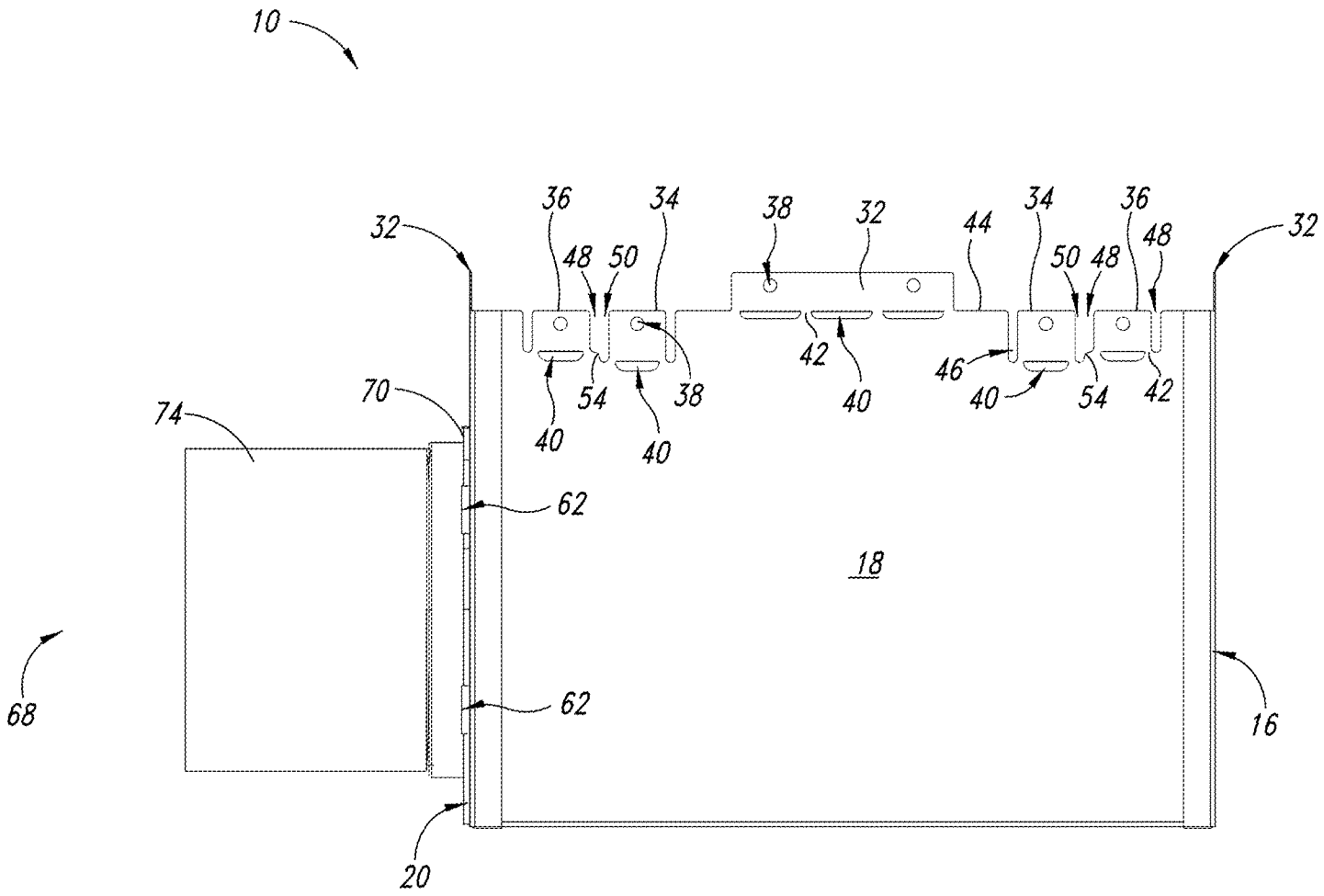
FIG. 3 is a left side elevational view of the fan housing of FIG. 1.
Figure 4:
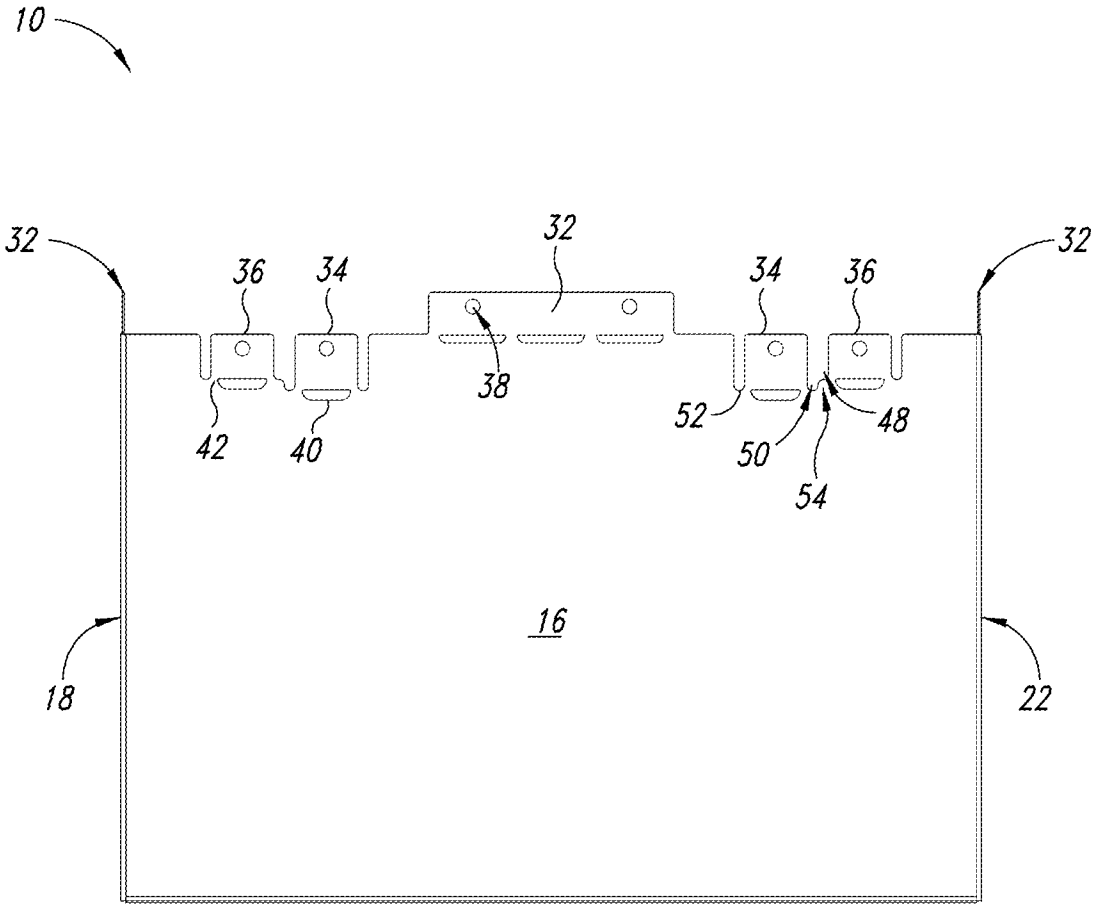
FIG. 4 is a rear elevational view of the fan housing of FIG. 1.
Figure 5:
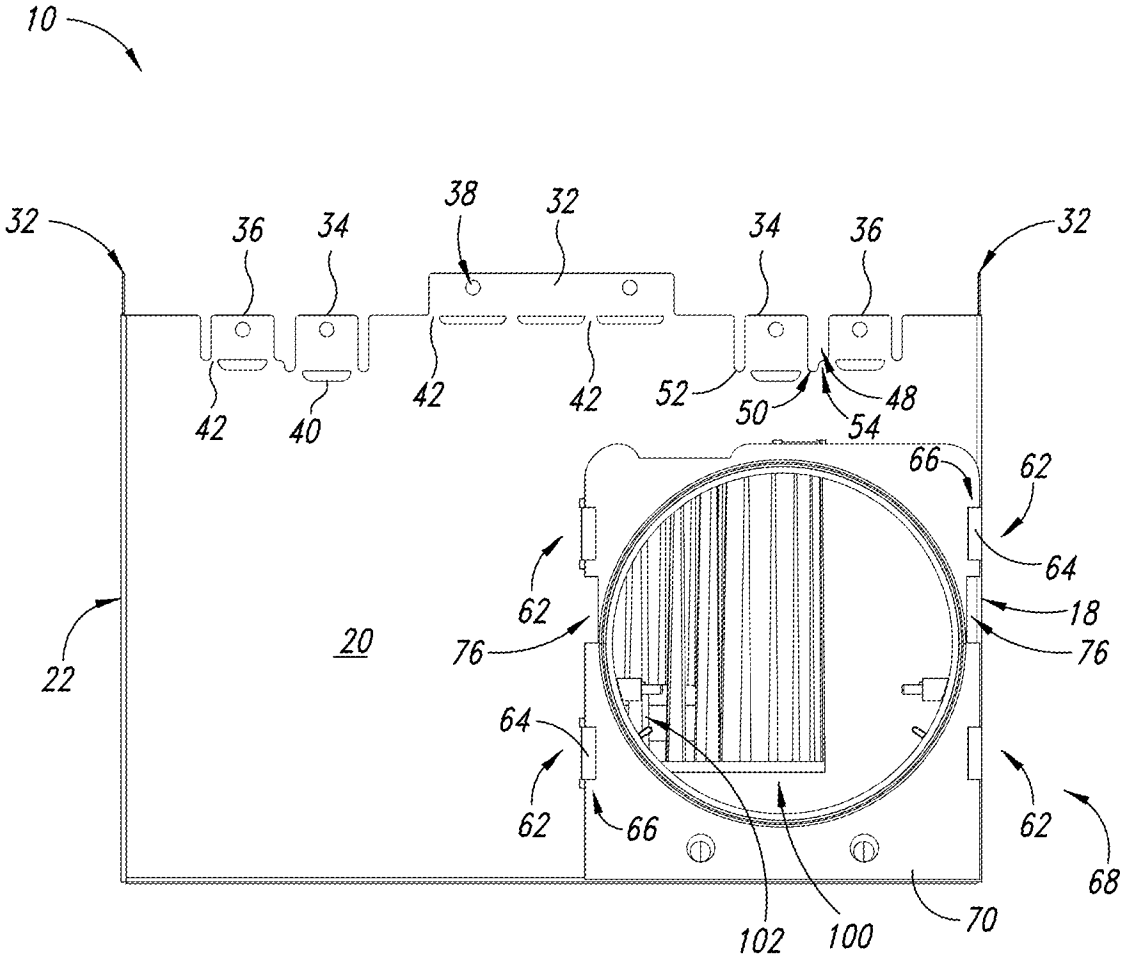
FIG. 5 is a front elevational view of the fan housing of FIG. 1.
Figure 6:
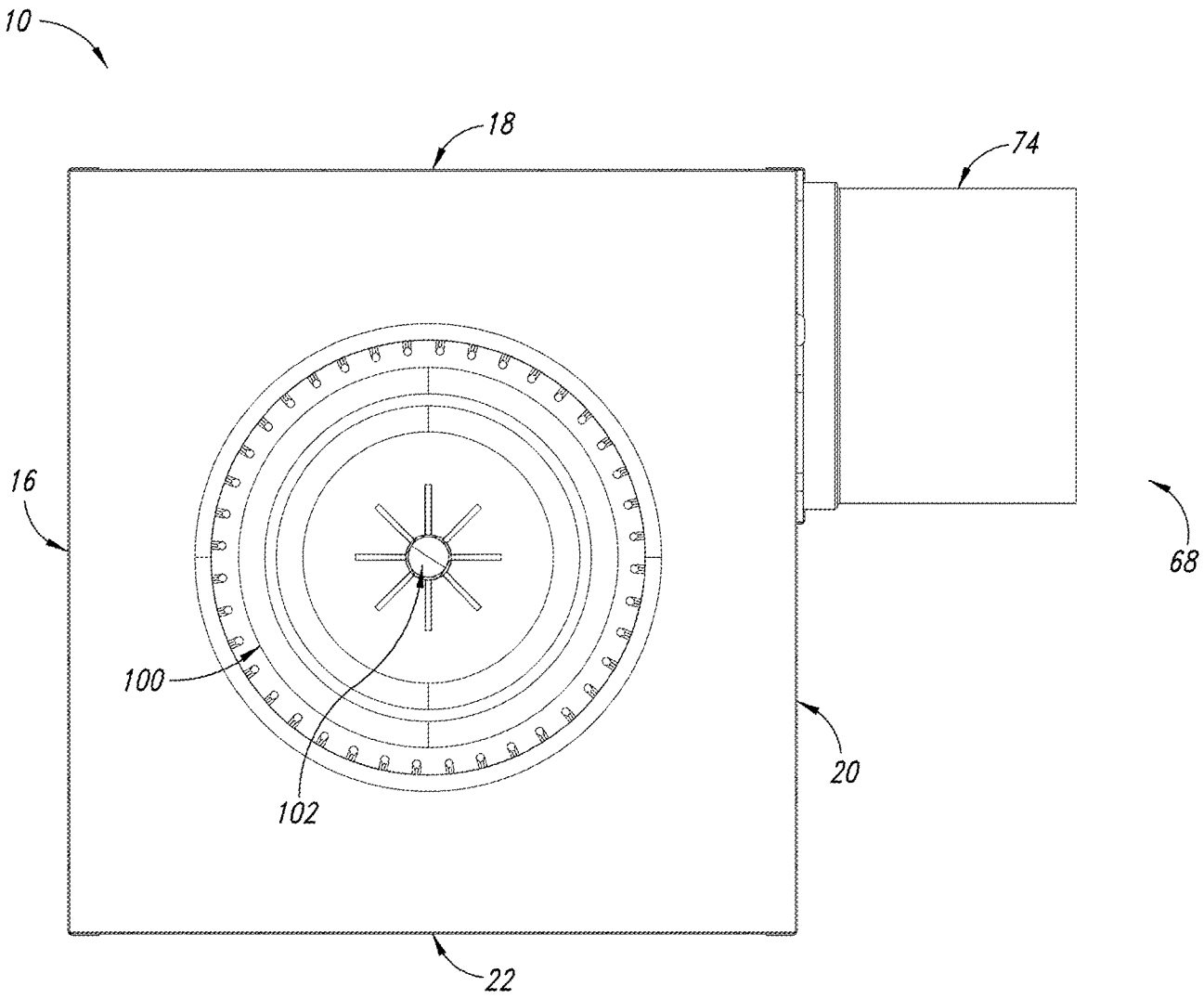
FIG. 6 is a bottom plan view of the fan housing of FIG. 1.
Figure 7:
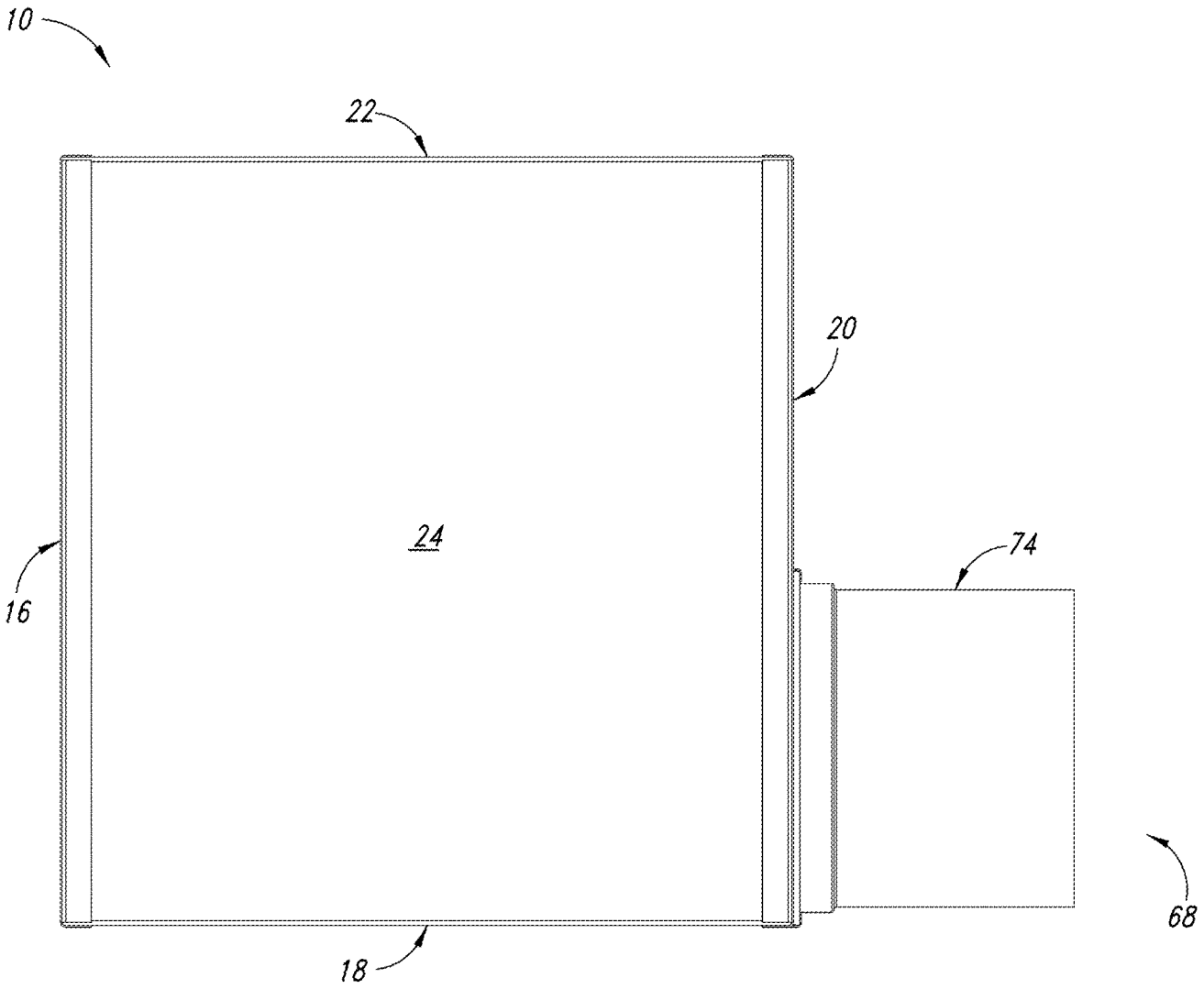
FIG. 7 is a top plan view of the fan housing of FIG. 1.
Figure 8A:
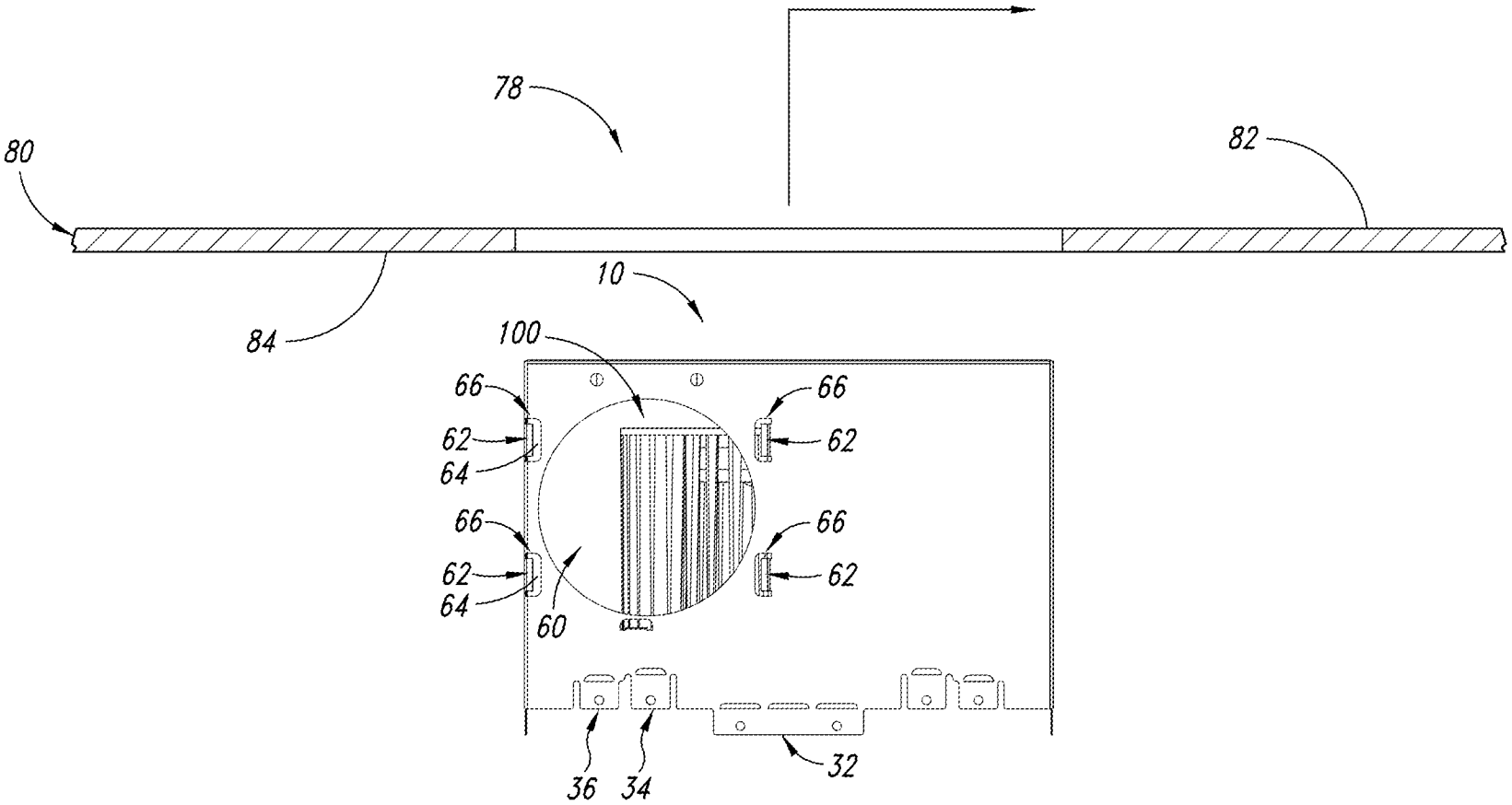
FIG. 8A is a partial cross-sectional front view of the housing below a rough opening prior to installation.
Figure 8B:
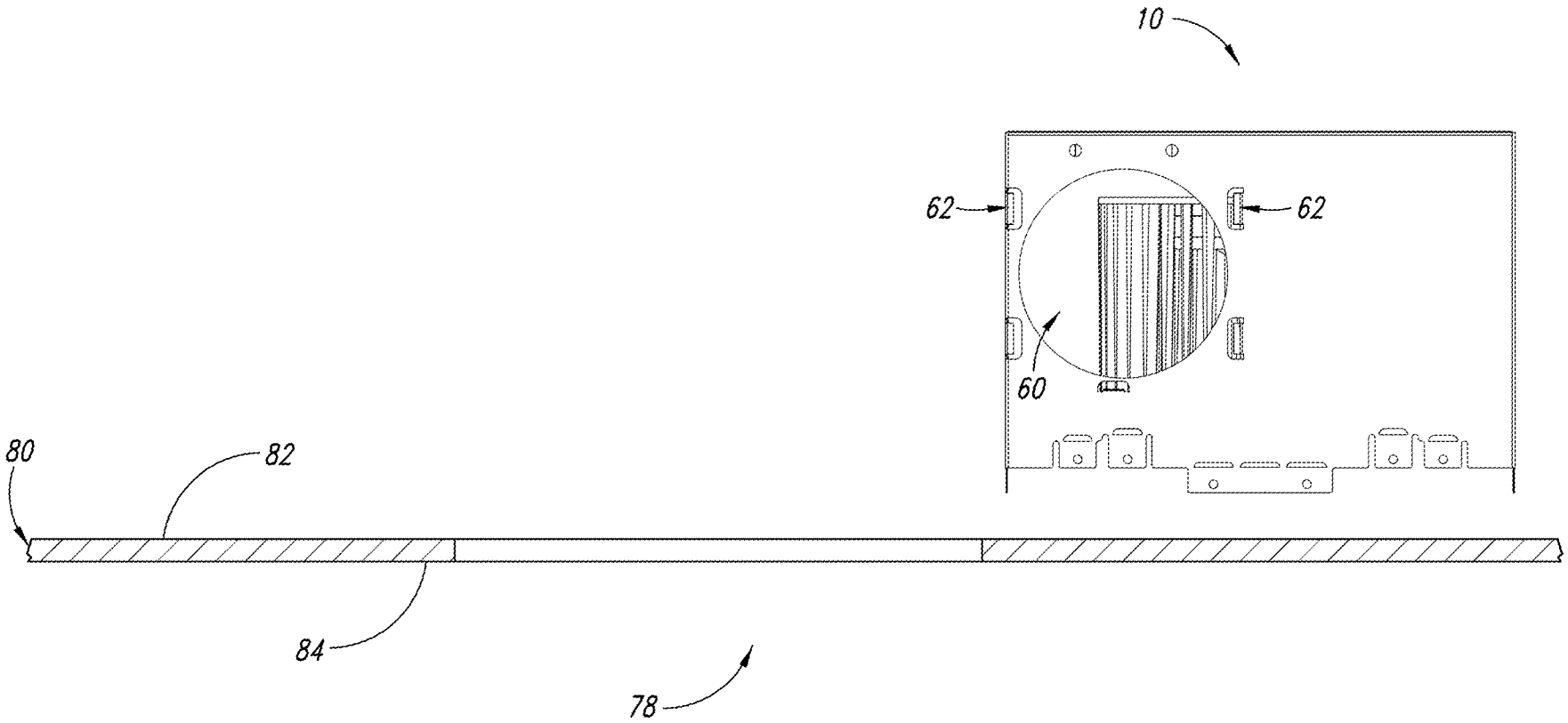
FIG. 8B is a partial cross-sectional front view of the housing inserted through the rough opening and positioned above the ceiling to the side of the rough opening.
Figure 9A:
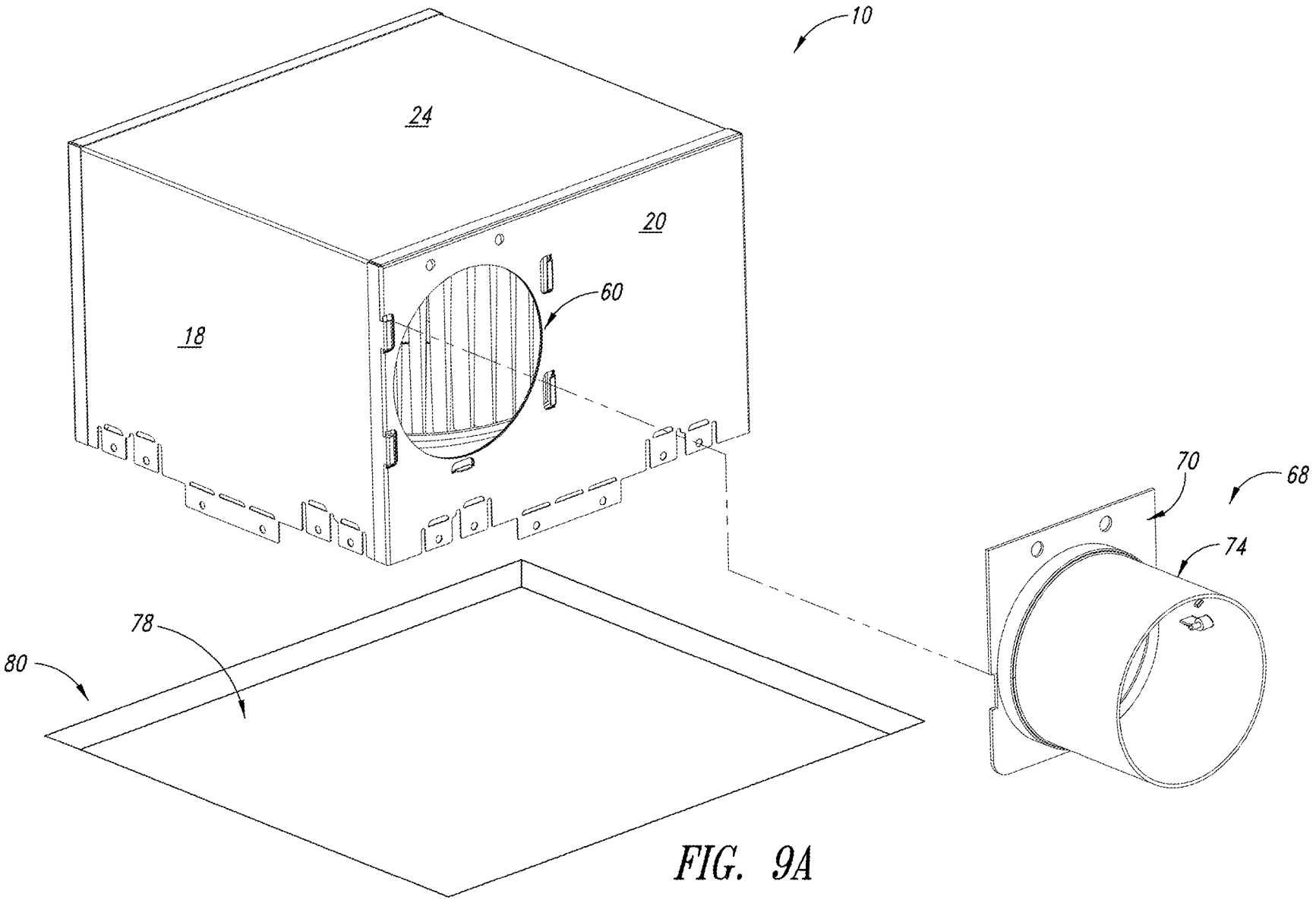
FIG. 9A illustrates the housing positioned above the rough opening with the vent duct connector in exploded view.
Figure 9B:
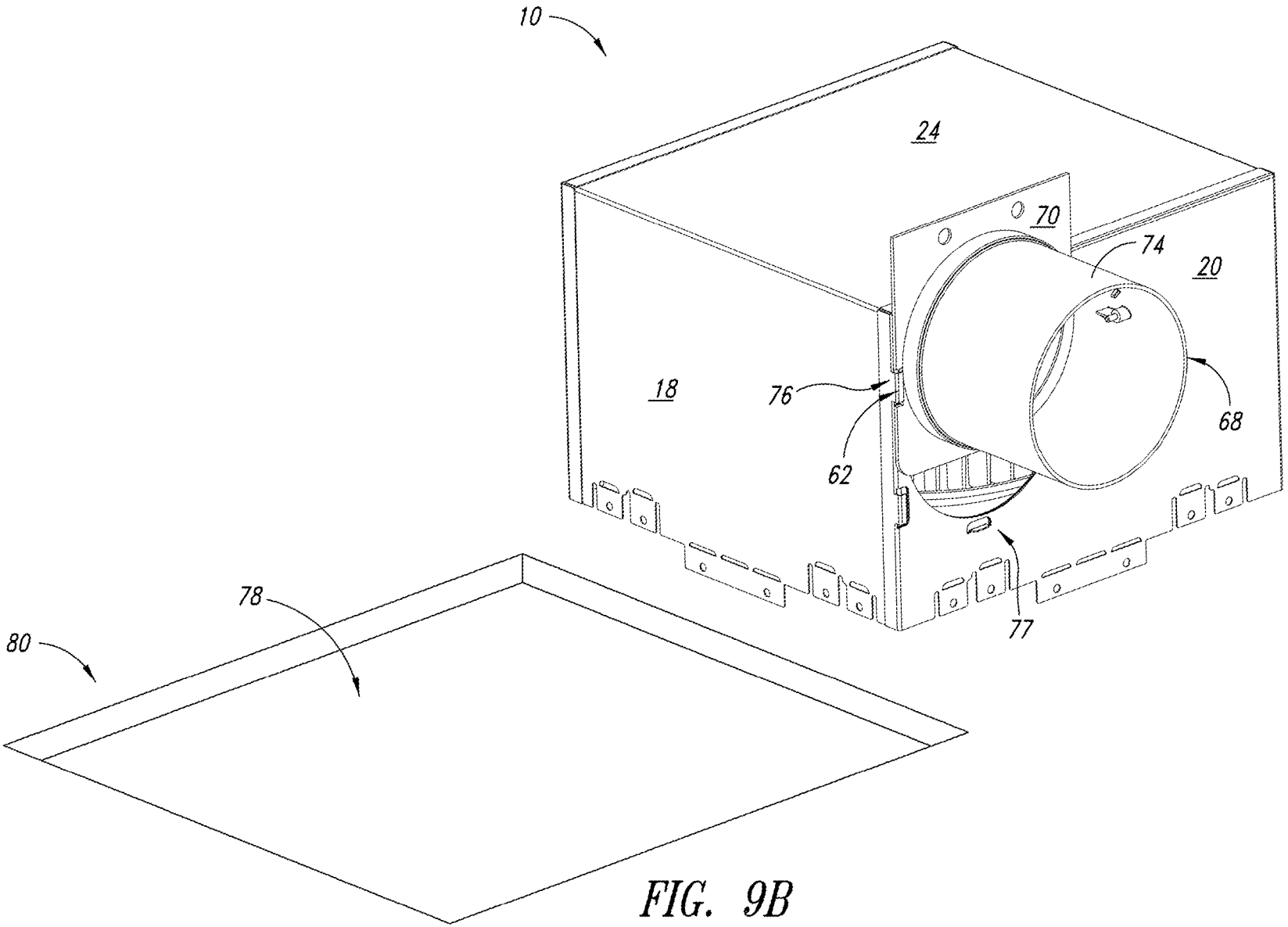
FIG. 9B illustrates the vent duct connector in an initial orientation against the housing.
Figure 9C:
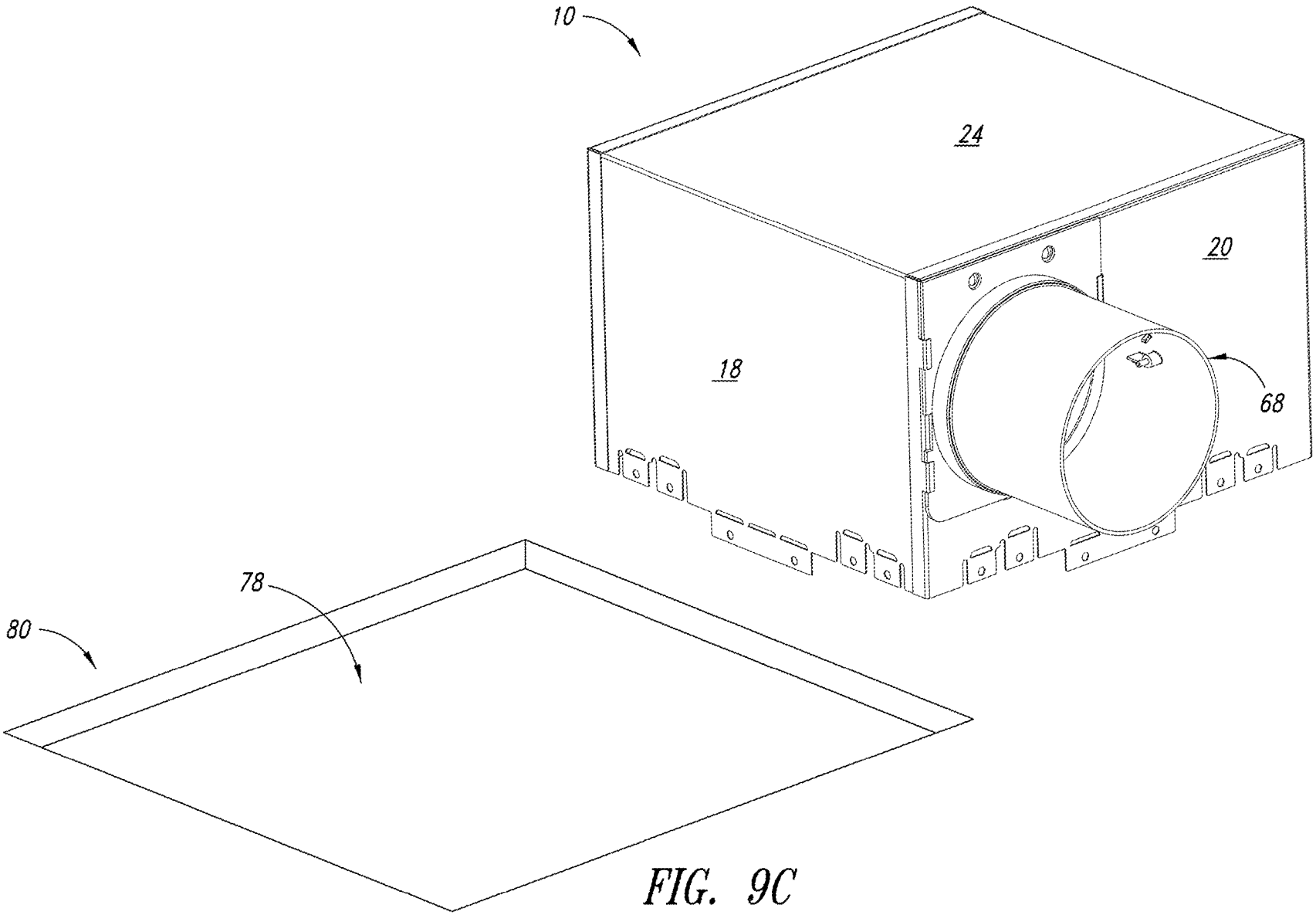
FIG. 9C shows the vent duct connector slid down the tracks into an installed position.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the use of fans, ducting, panels, walls, ceilings, and doors, as well as framing for walls, ceilings, doors, and the like, and installation processes for ceiling and wall fans have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Referring to FIGS. 1-7, shown therein is a housing 10 formed of at least one wall 12 that defines a housing interior space 14. Ideally the fan housing 10 has the fan 100, motor 102, and electrical connection (not shown) in the housing interior space 14 when it is sold or installed, although this is not required. The at least one wall 12 is formed to have a square planform shape defined by four sidewalls 16, 18, 20, 22 that are preferably—but not required to be—orthogonal to adjacent sidewalls, each sidewall 16, 18, 20, 22 having a substantially square or rectangular shape. An end wall 24 is formed at a closed end 26 of the housing 10, while the opposing side is an open end. The cross-sectional configuration of the housing is that of a rectangle, and the shorter walls 16, 20 cooperate with the longer walls 18, 22 to form a rectangular planform shape. It is to be understood that the cross-sectional shape may vary from a circle to any number of sides (polygon), and other geometric shapes, such as triangle (with three sides) or square, and the three-dimensional housing shape may take other forms, such as a cone.

Each of the sidewalls 16, 18, 20, 22 has a distal end 30 on which is formed a plurality of tabs that include a center tab 32, a pair of intermediate tabs 34, one on each side of and adjacent to the center tab 32, and a pair of outside tabs 36, each outside tab 36 adjacent to a respective intermediate tab 34. Although referred to as tabs, it is to be understood that a tab can be a flange, flap, strip, or similar component. Each tab 32, 34, 36 has optional openings 38 for a fastener if desired. The housing 10 is preferably formed of material, such as aluminum or other material having similar properties, with a thickness that permits manual bending of the tabs about the supporting legs as described below, in order to enable mounting of the housing 10 to a structural member, also as described below. The intermediate tabs 34 and outside tabs 36 extend upward to terminate evenly with the distal edge 44 of their respective wall 16, 18, 20, 22.

Ideally, each of the tabs 32, 24, 36 is co-planar with its respective wall 16, 18, 20, 22, when initially formed. However, the tabs 32, 24, 36 have a different bendable length and different bend lines to limit the length of the tab when it is repositioned to a bent configuration. Ideally the tabs 32, 34, 36 are formed to be bent at substantially a 90 degree angle to be orthogonal to the respective wall 16, 18, 20, 22 to which it is formed. For example, center tab 32 has one or more elongate opxenings 40 formed at the intersection of the center tab 32 and the respective wall 16, 18, 20, 22. The size and shape of these openings 40 is a matter of design choice and aesthetic appearance. Between these openings 40 are legs 42 that support the tab 32 on the wall 16, 18, 20, 22 and that enable bending in response to a manual force exerted on the tab 32. The manual force is preferably that of a human hand or the fingers of the human hand. Hence, the center tab 32 can be repositioned by manually bending about the legs 42 in a range of about 180 degrees either direction and, more preferably, to be orthogonal to the respective wall 16, 18, 20, 22, either towards the interior space 14 or towards the exterior of the housing 10, which is described more fully below.

The center tab 32 extends further than the terminal end or distal edge 44 of the respective wall 16, 18, 20, 22 a sufficient distance that, when the housing 10 is placed in the rough opening, the center tab 32 extends down below the exterior surface of the structural member (in this case a ceiling or wall).

The intermediate tab 34 is formed by two longitudinal elongate openings 46, 48 on each side of the tab 34 of equal length. An elongate opening 40 is formed below the intermediate tab 24 and between the two longitudinal elongate openings 46 to form two support legs 42 that are sized and shaped to yield to a manual force asserted on the intermediate tab 34, and to bend up to and beyond a 90 degree angle, such as about 180 degrees either direction (limited by bend allowance). As such, the tab 34 can be repositioned to any angle from 0 to about 180 degrees or −180 degrees relative to the wall 22, including a preferred 90 degree or right angle. The length of the intermediate tab 34, when it is repositioned, is determined by the distance of the respective opening 40 from the distal edge 44 of the respective wall 16, 18, 20, 22.

The outside tab 36 is formed by two longitudinal openings 50, 52 on either side and of equal length. The longitudinal opening 50 is longer than the adjacent longitudinal opening 48, and it joins the longitudinal opening 48 with a stepped bottom edge 54. The outside tab 36 is, thus, supported by two legs 42, as are the other tabs, and these two legs are separated by an elongate opening 40. The legs 42 bend adjacent the elongate opening 40, as do the legs of the other tabs 32, 24. However, the outside tab 36 is longer than the intermediate tab 34 due to the length of the longitudinal openings 50, 52, and this will form a larger tab 36 when force is applied to the tab 36 and the legs 42 bend in either direction. As with the center tab 32 and intermediate tab 34, the outside tab 36 can bend up to about 180 degrees (considering bend allowance) in either direction relative to the respective wall 16, 18, 20, 22. In this design, the outside tab 36 has a width of about ½ inch when it is bent about the legs 42, and the intermediate tab 34 has a width of about ⅝ inch when it is bent about its supporting legs 42.

As shown in the drawings, a duct opening 60 is formed in one of the walls, in this case the longer wall 20, and adjacent one edge of the wall 20. The opening can have a round or square shape, although almost any geometric or irregular shape may be used as needed. There are two L-shaped guides 62 on opposing exterior sides of the vent duct opening 60, each L-shaped guide 62 has a leg 64 spaced away from the wall 20 to create a slot or track 66. A vent duct connector 68 is provided having a flange 70 that is sized and shaped to be slid into place in the slots or tracks 66 of the guides 62 after the ducting 72 is attached thereto. It is also possible to attach vent duct connector 68 to the housing 10 prior to attaching the ducting 72. The vent duct connector 68 has a cylindrical extension or tubular nozzle 74 (with a back draft swing damper—not shown). The tubular nozzle 74 is connected to the ducting 72 by sliding the ducting 72 in place over the nozzle 74, and a clamp may be used to secure the ducting in place, which is a conventional method of attaching ducting and will not be described in more detail herein.

A unique feature of the present design is that the flange 70 material (preferably plastic) has two notches 76 on opposing sides that are sized and shaped to be slid over the L-shaped guides 62 so the vent duct connector 68 does not need to be raised up as high to get it started in the four tracks 66. This feature allows for a shallow opening installation.

Installation Process

A rough opening 78 is created in the structural member, here a ceiling 80, in which the fan and fan housing 10 in which the fan resides are to be mounted. The structural member can be a ceiling, a wall, a soffit, or other structural member of a residential or commercial building. Generally these structural members are formed from sheet rock or other interior wall or ceiling material that has a typical thickness of ½ inch or ⅝ inch. The rough opening 78 can be created for a new installation or it can be an existing rough opening in which an old fan is removed. In either situation, the rough opening 78 is prepped for the installation of the fan 100 and housing 10 of the present disclosure by sizing it to the correct dimensions of the housing 10.

After the rough opening 78 is prepared, the fan 100 and the housing 10 in which the fan resides are slid into the rough opening 78. The vent duct connector 68 is either already installed on the housing 10 as described above or it can be installed at this point by aligning the notches 76 with the upper L-shaped legs 62, then sliding the vent connector downward until it hits a stop 77 extending from the wall 20. The vent duct connector 68 can be installed before or after the housing 10 is placed through the rough opening 78. The vent duct connector 68 is then coupled to the ducting 72 by sliding the open end of the ducting over the nozzle portion 74 as described above.

The installer then repositions all the intermediate tabs 34 to about a 90 degree orientation with the respective wall 16, 18, 20, 22 when the structural member has a thickness of ⅝ inch. Alternatively, when the structural member has a thickness of about ½ inch, the installer will reposition the outside tabs 36 to an orientation of about 90 degrees with respect to the respective wall 16, 18, 20, 22. In either case, the tabs 34 or 36 are repositioned to face outwards away from the interior space 14 of the housing.

The housing 10 can now be placed over the rough opening 78 and will be supported on the top side or attic side 82 of the ceiling 80 by the respective intermediate tabs 34 or outside tabs 36. In this example the outside tabs 36 are used due to the thickness of the ceiling material 80. Next, the installer will reposition the center tabs 32 outward away from the interior space 14 of the housing 10 to bear against the bottom side or room side 84 of the ceiling 80 to sandwich the ceiling 80 sheet rock between the center tabs 32 and the respective interior tabs 34 or outside tabs 36 as the case may be.

A key feature related to the housing design is that this installation can always be done from the room side and without the need for screws or attic access. In addition, this is particularly useful in situations where tools may not always be available. The tabs can be repositioned or bent more than once, ideally two, three, or more times without failure due to fatigue and in order to facilitate removal and reinstallation as needed.

As will be readily appreciated from the foregoing, this design allows the installer to put the fan housing 10 up inside the rough opening and move it out of the way to work on the vent duct connection and the electrical connection. Preferably eight intermediate or outside tabs 34, 36 hold the housing 10 in the opening from the attic or interior wall side, and the center tabs 32 are used to secure it to the sheet rock on the room side. However, it is to be understood that more than eight or fewer than eight intermediate or outside tabs can be used as desired.

The electrical connections are located towards the room side so the connection can be done from the room side. Another unique feature is the sheet rock grab with the tabs. The notches on the vent duct connector enable the slide-in installation of the vent duct connector 68 and room side electrical to be a combined true "room side" installation or retrofit. New construction has access to studs and attic, so this design and method works well for new construction. This high level of ease on the room side has never been done before.

Another unique aspect of this design is the plastic has two notches so the installer does not need to raise the plastic up as high to get it started in the four metal tracks. This feature allows for a shallow opening installation.

The weight of the fan body and the pinching of the metal tabs is enough to overcome the low fan vibration.

It is to be appreciated that various aspects of the housing 10 and vent duct connector 68, taken alone and in combination, provide an aesthetic appearance that extends beyond any functionality associated therewith. Non-limiting examples include radius of curvature, symmetry, and balance, use of geometric shapes not dictated by function, and the like.

Figure 12:
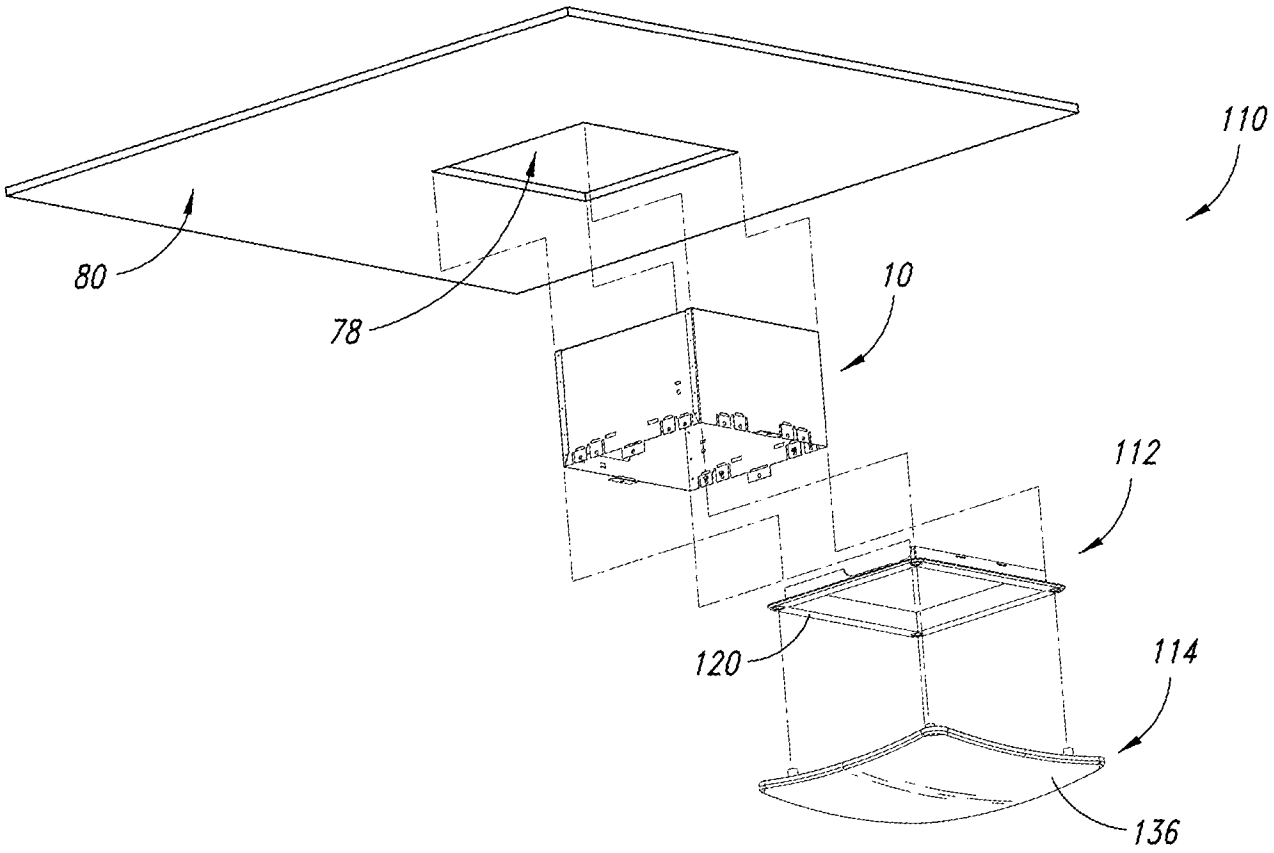
FIG. 12 is an axonometric exploded view of a ventilation system formed in accordance with the present disclosure that utilizes the fan housing of FIG. 1.
Figure 13:
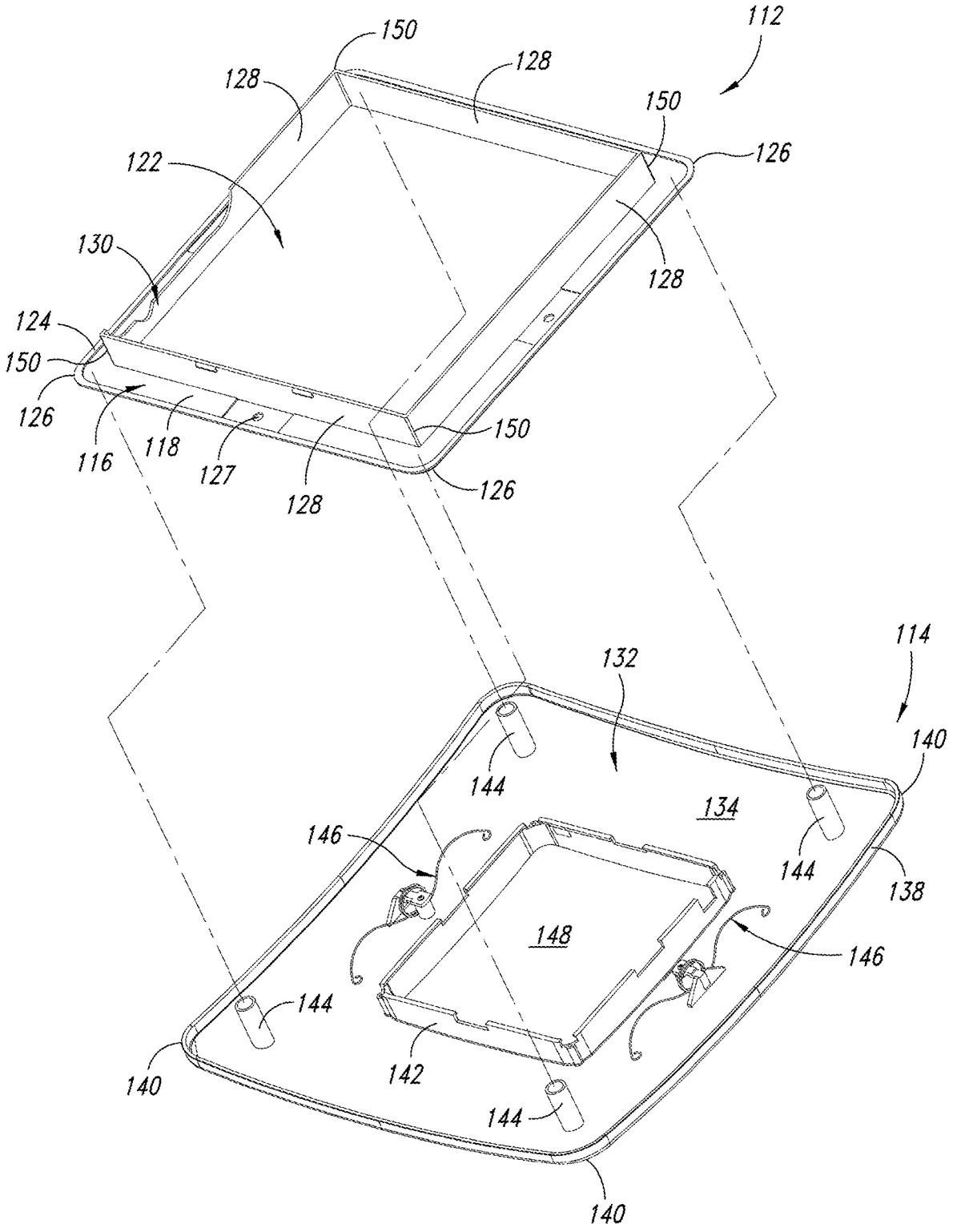
FIG. 13 is an axonometric exploded view of the relationship of a trim ring and cover used in the ventilation system of FIG. 12.
Figure 14:
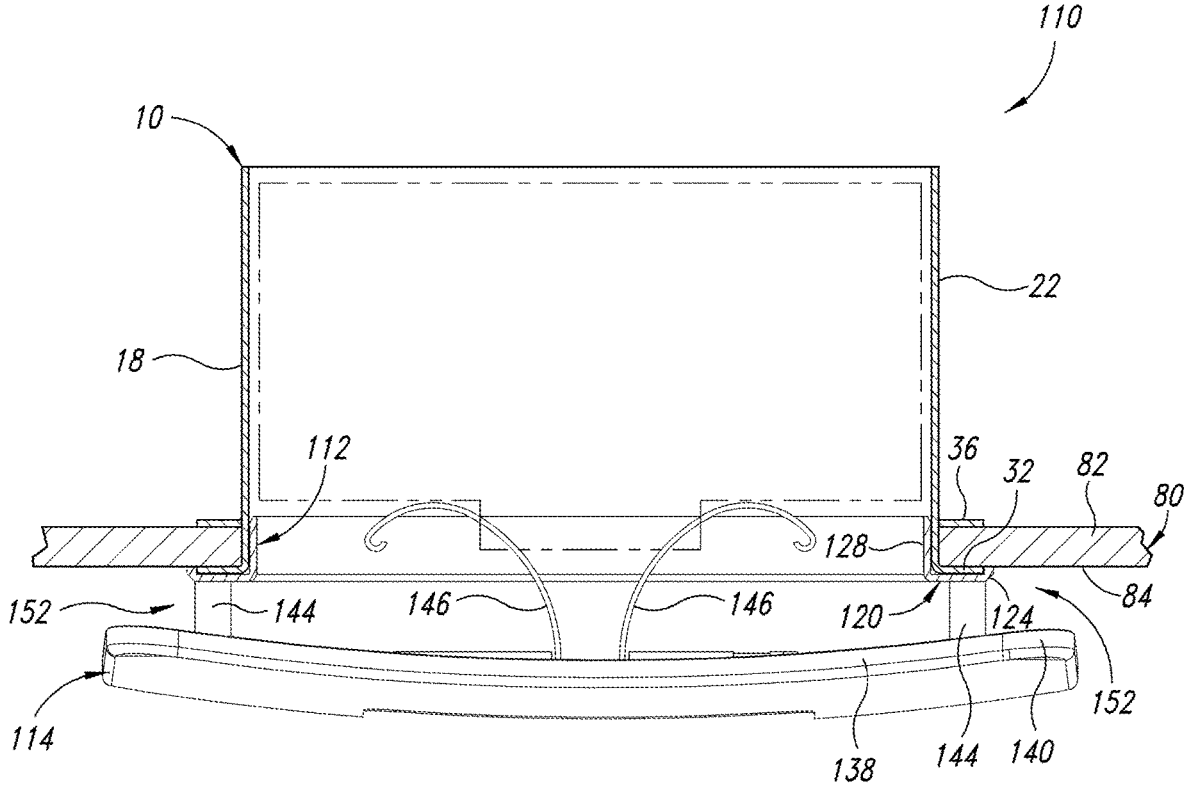
FIG. 14 is side view in partial cross section of the assembled ventilation system of FIG. 12.

Turning next to FIGS. 12-14, illustrated therein is a complete ventilation system 110 installation formed in accordance with another aspect of the present disclosure. As shown therein, the fan housing 10 is combined with a trim ring 112 and cover 114 to form a completed system 110 installation as shown in FIG. 14.

Figure 10A:
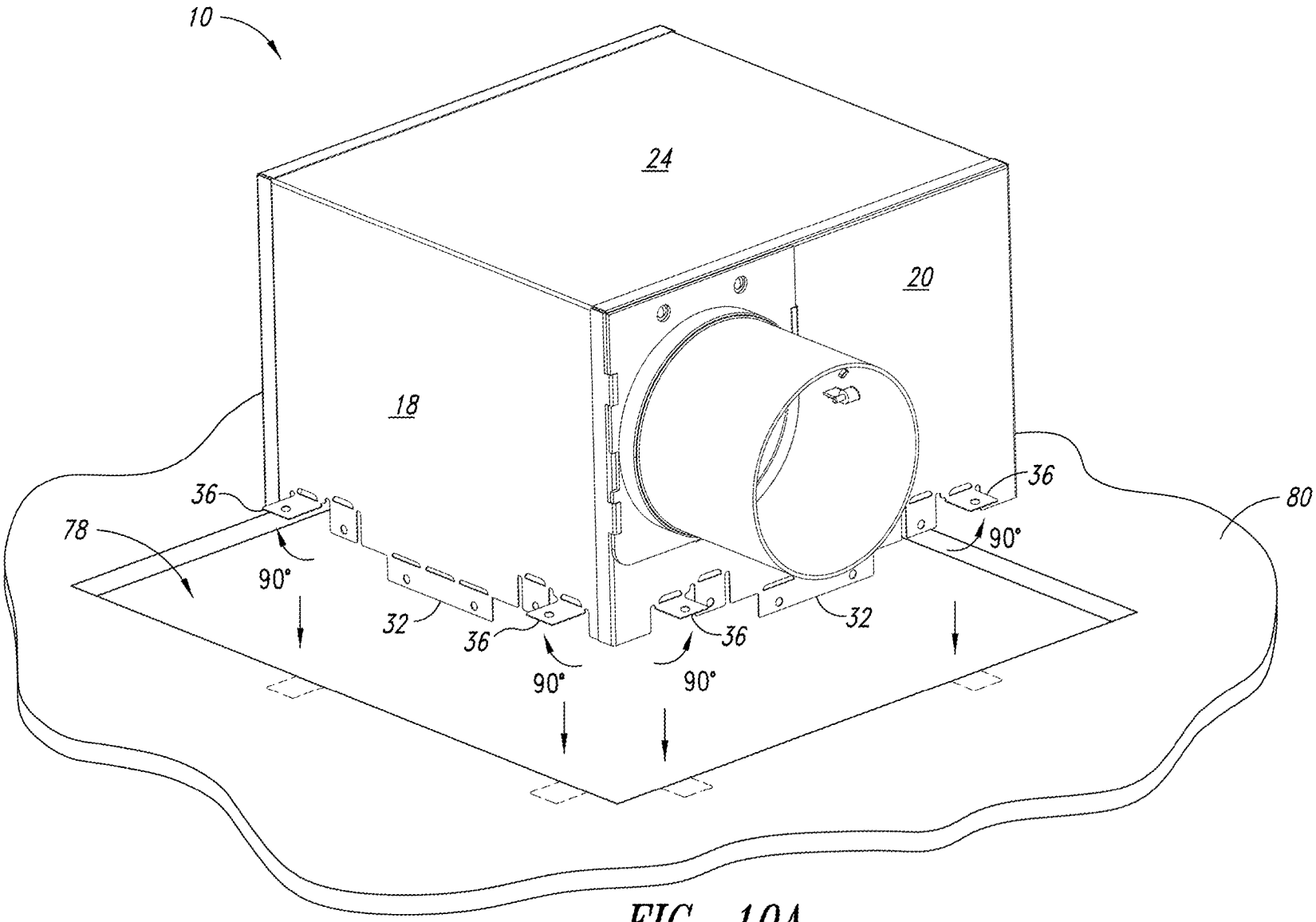
FIG. 10A is an illustration of the assembled housing and vent duct connector positioned above the rough opening with the outer tabs orthogonal to their respective walls.
Figure 10B:
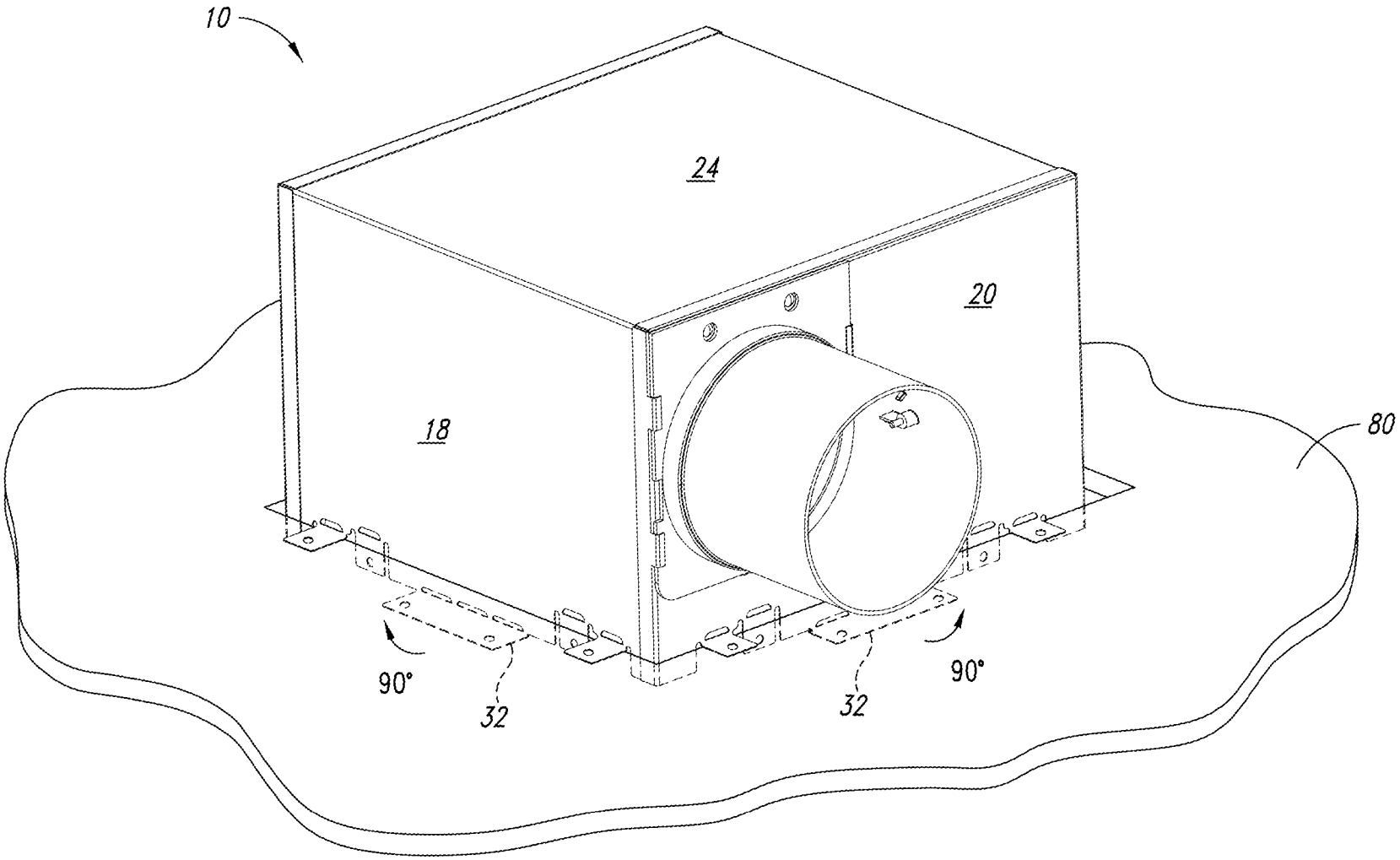
FIG. 10B is an illustration of the assembled housing and vent duct connector positioned in the rough opening and supported by the outer tabs on top of the structural member and held in place by the center tabs on an opposing side of the structural member.
Figure 11:
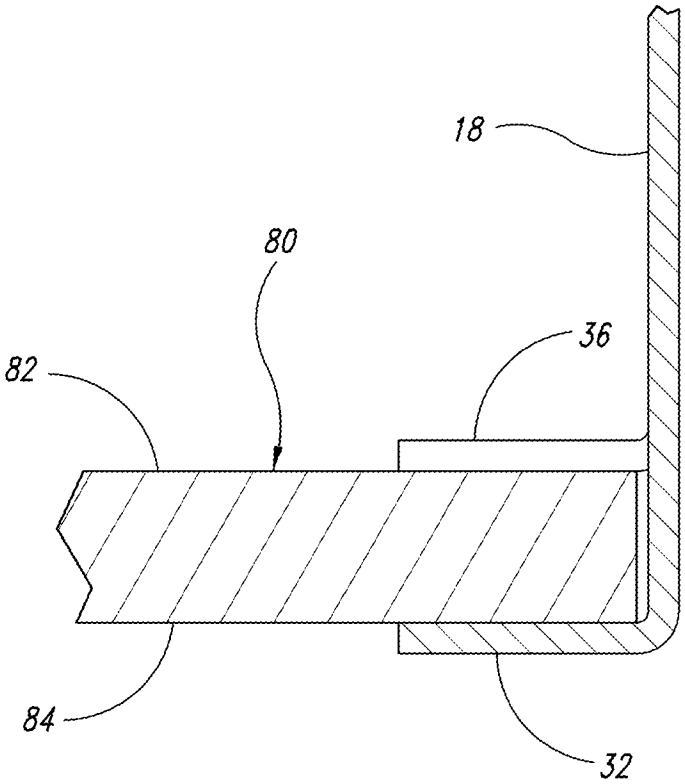
FIG. 11 is a partial cross-sectional side elevation showing the outer and center tabs holding the housing in place on the ceiling.

FIG. 12 is an isometric exploded view of the ventilation system 110 positioned below the rough opening 78 in the ceiling 80. The housing 10 is installed in the rough opening 78 as described above in connection with FIGS. 10A-11. Once the fan housing 10 is secured in place with the ducting, and the wiring is connected, the trim ring 112 is placed on the housing.

FIG. 13 is an axonometric exploded view of the trim ring 112 and the cover 114 showing the details of the interior of both. It is to be understood that many aspects of the trim ring 112 and cover 114 are ornamental in nature, including without limitation the size, shape, and symmetry of the exterior, such as the geometric shape, radius of curvature or lack thereof of the exterior corners, the thickness, the relative positioning of the trim ring 112 and grille cover 114.

As can be seen in FIG. 13, the trim ring 112 has a substantially square planform shape with a flat circumferential ledge 116 that has an interior surface 118 and exterior surface 120 (seen in FIG. 12) that circumscribes a central opening 122. The exterior edge of the ledge 116 has a lip 124 that is turned up towards the ceiling 80 when installed. The size and shape of the lip 24 accommodates the tabs on the housing 10, as will be explained in more detail in connection with FIG. 14 below. The four corners 126 on the trim ring 112 are rounded for appearance only, and the radius of curvature is chosen based on cosmetic appearance only. Optional punch-through depressions 127 are formed on the interior surface 118 of the ledge 116, centrally located on each side, for use in installation with fasteners if desired. These are not visible on the exterior surface 120 of the ledge 116.

An upstanding wall 128 is formed on an interior edge of the ledge 116 to circumscribe the opening 122. It is sized and shaped to fit inside the housing 10, as described more fully below in connection with FIG. 14. Ideally the trim ring has an interference fit or friction fit in the housing, including friction fit notches to hold it in place.

A cutout 130 is formed in one of the walls 128 that is sized and shaped to accommodate the vent duct connector 68 described above.

The cover 114 has a substantially square planform shape with a single wall 132 with an interior surface 134 and exterior surface 136. As can be seen more clearly in FIGS. 12 and 14, the cover 114 is concave on the interior surface 134 with an open top and correspondingly concave on the exterior surface 136 to form a closed bottom, similar to a shallow bowl. A lip 138 extends outward and away from the interior surface 134 and circumscribes the exterior of the cover. The four corners 140 of the cover 114 and the lip 138 are preferably rounded purely for cosmetic purposes. The radius of curvature is selected to cooperate with the corners 126 of the trim plate 112 to provide an attractive appearance.

An upstanding wall 142 is formed to circumscribe a middle portion of the interior surface 134 of the cover 114. The wall 142 has a height that is sized to avoid interfering with the housing 10 and the components inside the housing 10 when the cover is mounted thereon. The upstanding wall 142 forms an enclosure 144 that houses an optional lighting system that will not be described in detail herein. The cover 114 is preferably formed of translucent material that permits light to pass through without enabling viewing of the inside of the housing 10. The central area 148 bounded by the upstanding wall 142 may be clear if there is a cover attached to the wall 142 over the area 148. However, it is preferred that the material be translucent for the central area 148 as well as the entire cover 114.

A standoff 144 is formed adjacent each corner 140 to extend upward and away from the interior surface 134. Each standoff has a circular cross-sectional shape purely for ornamental reasons, and it is to be understood that they may have different cross-sectional shapes, such as square, hexagonal, octagonal, and other geometric shapes without affecting their function. The standoffs 144 are positioned to bear against the trim ring when the cover 114 is attached to the housing 10, thus assisting in holding the trim ring to the housing. The standoffs 144 further have a height from the interior surface 134 that is sized to space the wall 132 away from the ceiling 80 so as to provide a gap between the lip 138 and the ceiling 80 as described more fully below. Included on the cover 114 are a pair of spring clips 146 affixed to the interior surface 134 on opposing sides of the upstanding wall 142. These are conventional spring clips 146 that are readily commercially available and will not be described in detail herein. The clips 146 engage the housing 10 as described below to hold the cover 114 to the housing 10 with the standoffs 144 pressed against the trim plate 112, thus holding the trim plate 112 in place.

FIG. 14 is a side view in partial cross section of the assembled ventilation system 110. As can be seen, the housing 10 is held in place with the tabs 32 and 36 as described above. Once the housing 10 is attached to the ceiling 80, the trim ring 112 is slideably engaged with the housing so that the upstanding wall 128 bears against the inside of the respective one of the walls 16, 18, 20, 22 of the housing 10. Preferably the upstanding wall 128 extends upward only to the location of the bend line of the center tab 36, which is near the top surface 82 of the ceiling 80. When the cover 114 is installed, the ledge 116 will bear against the lower tab 32 with the lip 124 on the ledge 116 bearing against the bottom side or room side 84 of the ceiling 80. As can be seen, the height of the lip is sized to accommodate the thickness of the lower tab 32 so the trim ring prevents exposure of the tabs 32, 34 to view from the room side 84 of the ceiling 80. At this point, the trim ring 112 is held in place to the housing 10 by a friction fit between the walls 128 (and corners 150 of the walls 128) with the housing 80.

The cover 114 is then placed in position with the pair of springs 146 engaging the housing 10 in a conventional manner known to those of skill in the art. In one implementation the springs 146 engage slots (not shown) in the housing 10. The springs 146 allow the cover 114 to be pulled away from the ceiling 80 a short distance while still engaging the housing 10 through the springs 146. When the cover 114 is pushed further towards the ceiling 80 and the housing 10, the standoffs 144 will bear against the lower surface 120 of the trim ring ledge 116, thus holding the trim ring 112 in place. The standoffs 144 are sized to create a gap 152 between the lip 138 and the room side surface 84 of the ceiling 80 that allows air to be drawn into the housing 10 by the fan 100.

Figure 15:
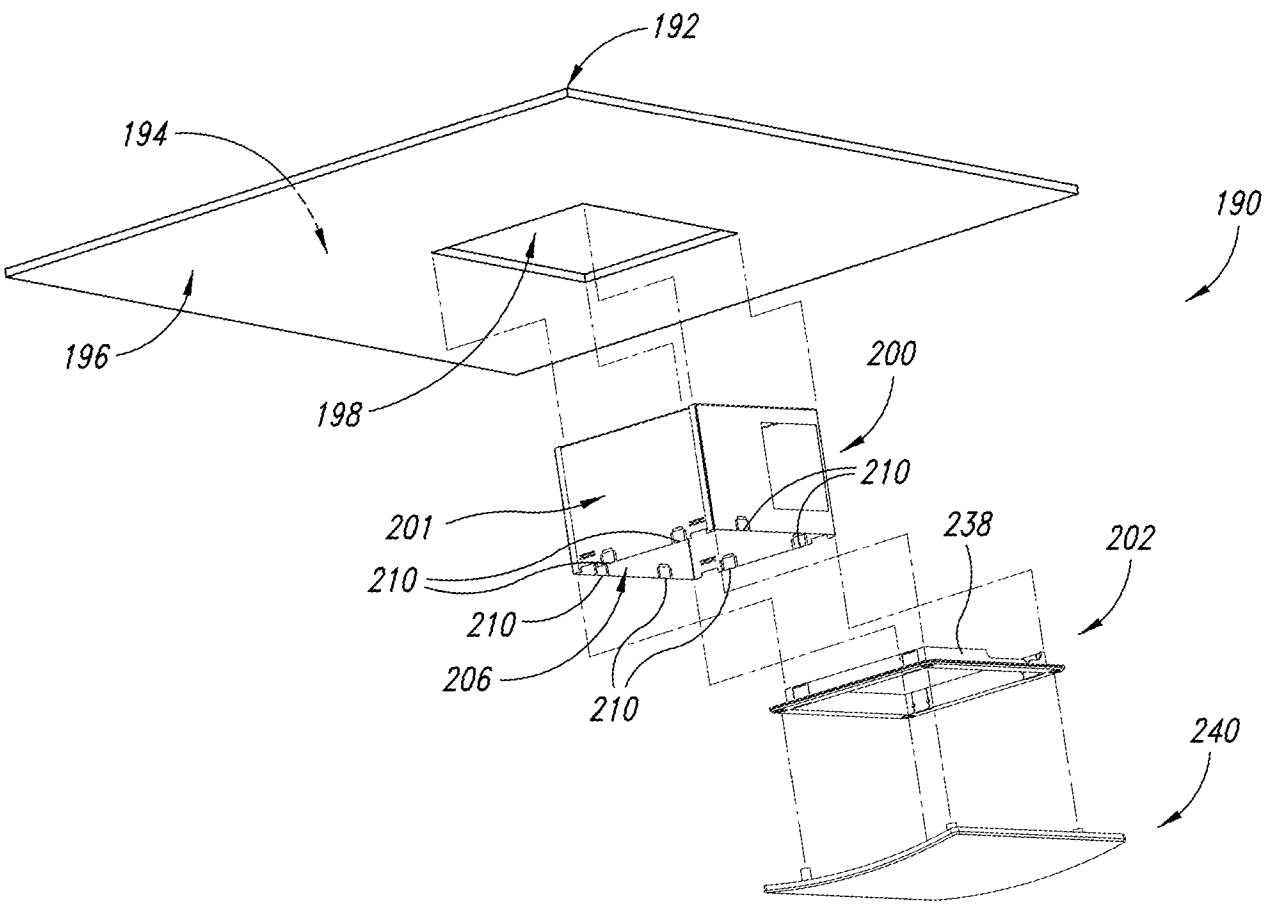
FIG. 15 is an exploded axonometric illustration of a housing and a trim ring formed in accordance with another aspect of the present disclosure.

FIG. 15 is an exploded axonometric illustration of an assembly 190 for use with a structural member 192 having opposing first and second surfaces 194, 196 and an opening 198 formed therein that communicates with the first and second surfaces 194, 196. The assembly 190 includes a housing 200 a trim ring 202, and in one implementation a cover or shield 204 to cover the trim ring and housing, all formed in accordance with another aspect of the present disclosure. The housing 200 has at least one wall 201 that is sized and shaped to define an interior 206 to house the object, in this case a ventilation fan 208. The housing is sized and shaped to be received within the opening 198 in the structural member 192, such as a ceiling or wall. It is to be understood that the housing 200 and the opening 192 can be other than rectilinear as shown throughout this disclosure. Other shapes include cylindrical, rectangular, triangular, and other well-known geometric shapes. The housing 200 has at least one support tab 210 that is a bendable flange formed in the at least one wall 201 that can be bent to extend outward from therefrom to bear against the first surface 194 of the structural member 192 and support the housing 200 on the structural member 192. The housing 200 further includes at least one opening and preferably two pairs 212, 214 of first and second openings 216, 218 each.

The trim ring 202 having an interior side 220 and an opposing exterior side 222, the interior side 220 having at least one resilient tab and preferably at least two tabs 224 with a distal end 226 sized and shaped to releasably engage the first opening 216 or the second opening 218 in the housing 200. The trim ring 202 further includes at least one second member, such as a ledge 228 sized and shaped to bear against the second surface 196 of the structural member 192 when the tab 224 is engaged with the first or second opening 216, 218 in the housing 200 and thereby hold the trim ring 202 in place on the housing 200 while bearing against the second surface 196 of the structural member 192. Ideally the trim ring 202 includes an upstanding wall 238 in which the tabs 224 are preferably integrally formed.

In accordance with a representative implementation of the present disclosure, the housing 200 has a distal end 230 of the at least one wall 201, and the at least two pairs 212, 214 of first and second openings 216, 218 are formed in the at least one wall 201 with the first opening 216 opening positioned at least partially between the second opening 218 and the distal end 230 of the at least one wall 201. Preferably the first opening 216 is aligned with the second opening 218 to form a ladder arrangement of the openings in relation to the distal end 230 of the at least one wall 201. In addition, the upstanding wall 238 of the trim ring 202 is sized and shaped to fit within the interior 206 of the housing 200 and the trim ring 202 has a lip 232 extending from the distal end of the tab 234 that is sized and shaped to be received in either one of the first and second openings 216, 218 in a respective one of the at least two pairs 212, 214 of first and second openings 216, 218.

Figure 16:
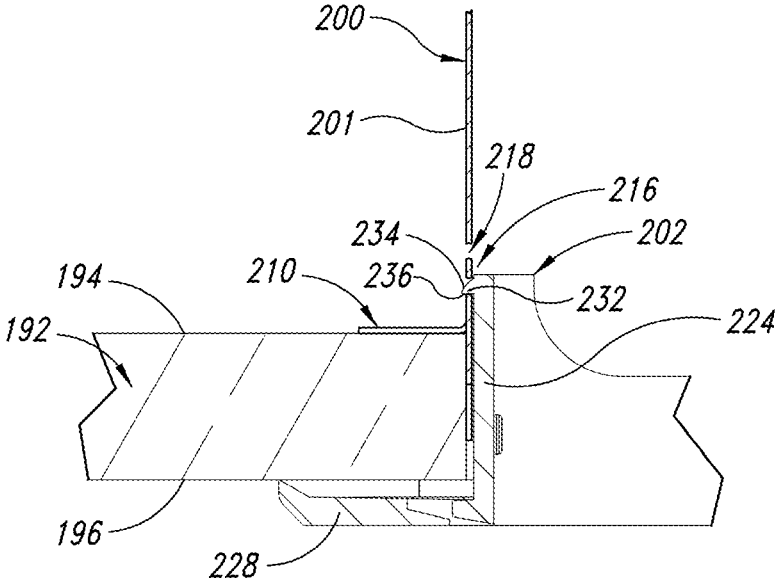
FIG. 16 is a partial cross sectional side view of a trim ring with tab engaged with a first opening in the housing.
Figure 17:
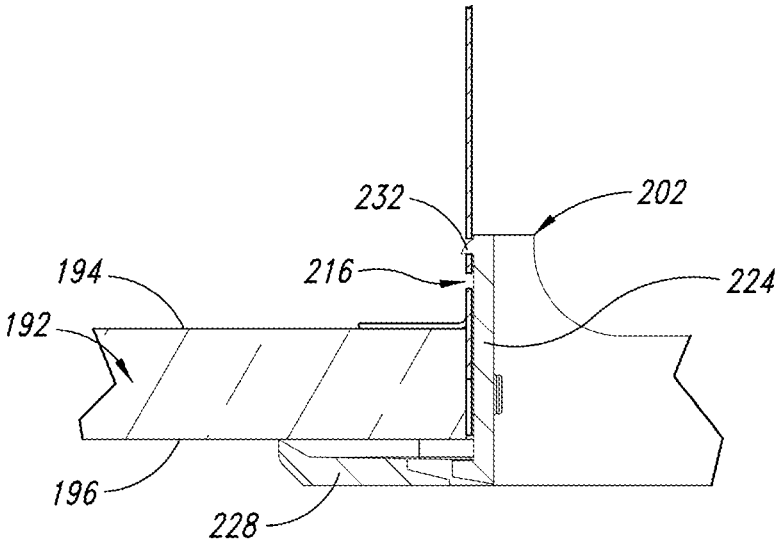
FIG. 17 is a partial cross sectional side view of a trim ring with tab engaged with a second opening in the housing.

As shown more clearly in FIGS. 16 and 17, preferably the lip 232 has a convex distal surface 234 and an opposing planar bottom surface 236. FIG. 16, which is a partial cross section side view of the trim ring 202, the lip 232 on the tab 224 is engaged with the first opening 216 in the housing, and in FIG. 17, which is also a partial cross section side view of the trim ring 202, the lip 232 on the tab 224 is engaged with the second opening 218 in the housing 200. These two views show the trim ring 202 in use with the housing 200 and the structural member 192.

The installation of the housing 200 and trim ring 202 on the structural member 192 includes forming the opening 198 to allow the housing 200 to be slid through the opening 198 and to rest temporarily on the first surface 194, such as the interior surface of a ceiling. The support tab 210 is then bent outward at each location on the at least one wall 201 of the housing. In one implementation there are two support tabs on opposing side walls of a rectilinear housing 200 as shown in FIG. 15, plus one support tab 210 on a front wall where the duct opening is located, and two support tabs 210 on an opposing back wall. The number, size, shape, and placement of the support tabs 210 can be varied and mixed on each housing 200.

After the support tabs 210 are bent outward, the housing 200 is positioned in the opening 198 and lowered down until the support tabs 210 bear against the first surface 194 of the structural member 192. The trim ring 202 is then positioned with the upstanding wall 238 in alignment with the housing 200 below the structural member 192. The upstanding wall is slid inside the at least one wall 201, and the tabs 224 will have their respective lip 232 vertically aligned with the respective pair 212, 214 of first and second openings 216, 218. As the trim ring 202 is slid upward, the lip will ratchet through the first opening 216 and into the second opening 218 if the structural member 192 is of a first smaller thickness, such as ½ inch. If the structural member 192 is of a larger thickness, such as ⅝ inch, then the lip 232 on the tab 224 will lock into place in the first opening 216.

In FIG. 16, the housing 200 and trim ring 202 are installed on a thicker ⅝ structural support 192. The support tab 210 on the housing 200 is bent to be orthogonal to the at least one wall 201 and to bear against and support the housing 200 on the first surface 194 of the structural member 192. The trim ring 202 is positioned so that the tab 224 engages the first opening 216 via the lip 232. The planar bottom surface 236 of the lip 232 rests on the lower edge of the first opening 216.

In FIG. 17, the housing 200 and trim ring 202 are installed on a thinner ½ inch structural support 192. The support tab 210 on the housing 200 is again bent to be orthogonal to the at least one wall 201 and to bear against and support the housing 200 on the first surface 194 of the structural member 192. The trim ring 202 is positioned so that the tab 224 engages the second opening 218 via the lip 232. The planar bottom surface 236 of the lip 232 rests on the lower edge of the second opening 218.

Figure 18:
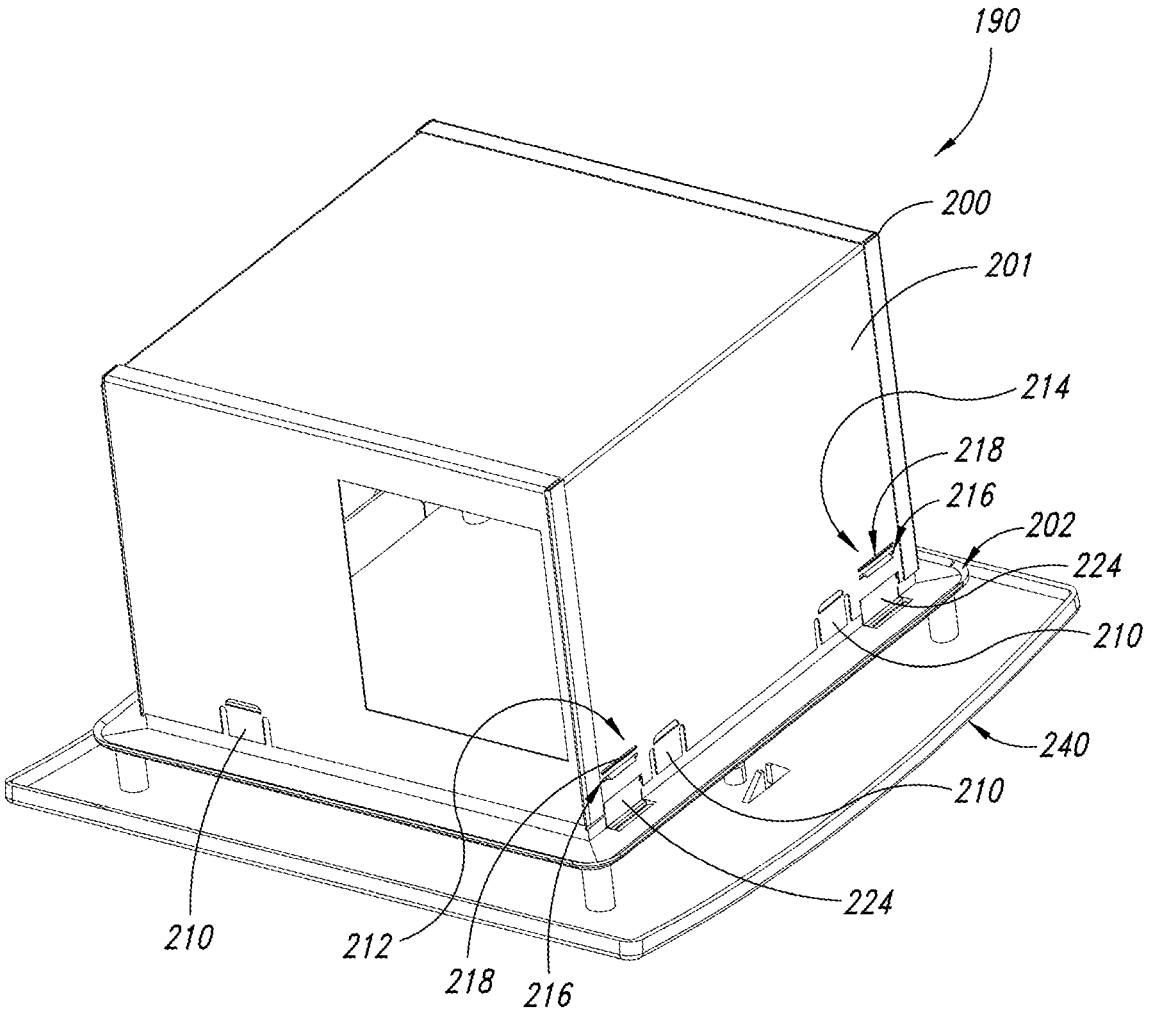
FIG. 18 is an axonometric view of a ventilation fan assembly including housing, trim ring, and shield.

FIG. 18 is an axonometric view of the assembled ventilation fan assembly 190 including housing 200, trim ring 202, and shield 240 but without the structural member 192 in order to better show the relationship of the components. The shield 240 is substantially the same as the cover 114 described above and its installation is also substantially the same. Hence, it will not be described in detail herein.

Figure 19:
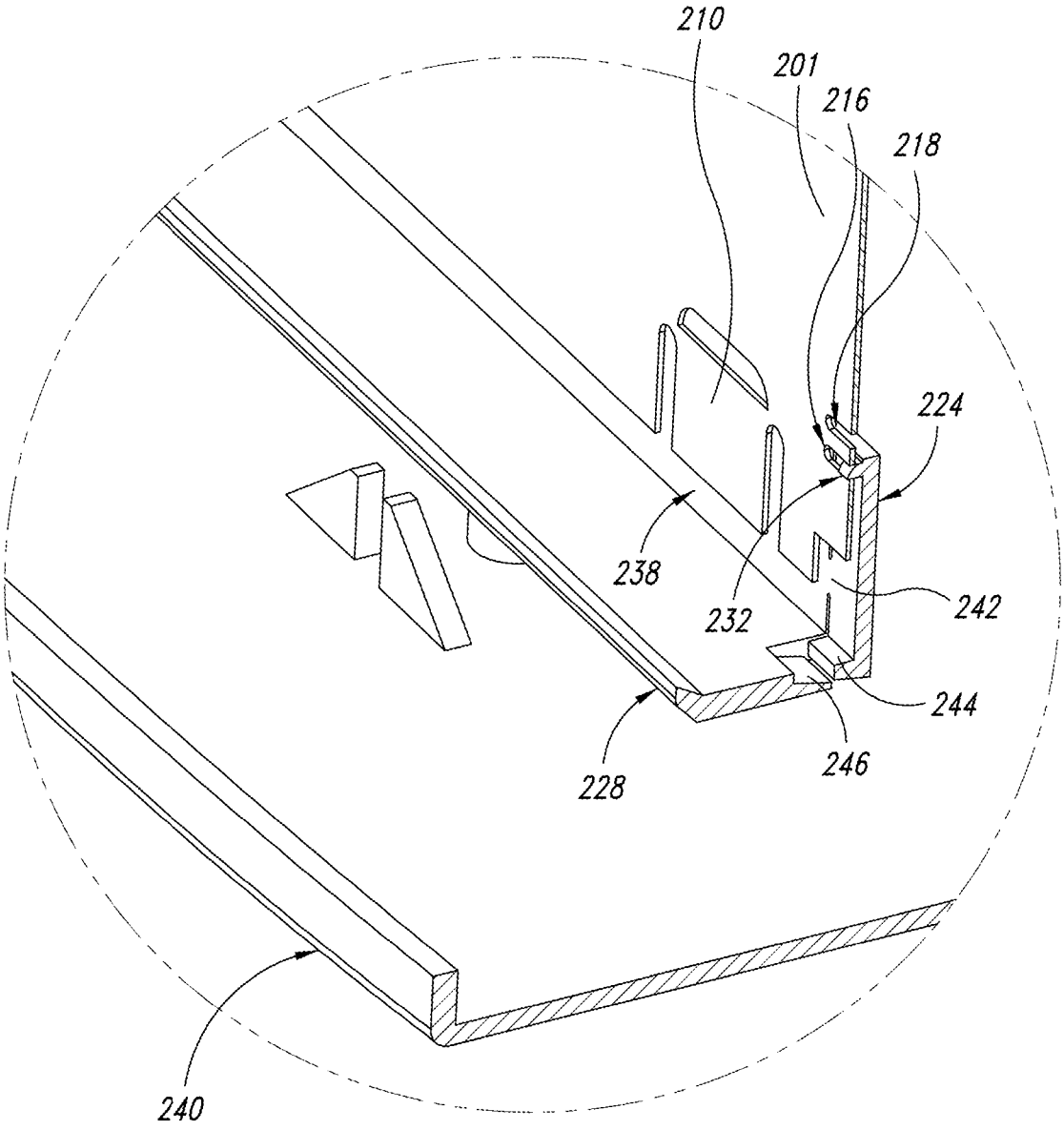
FIG. 19 is an enlarged, axonometric, cross sectional view of one side the assembled components.

FIG. 19 is an enlarged axonometric cross section view of the tab 224 and its relationship to the upstanding wall 238 on the trim ring 202. Preferably the tab 224 is integrally formed with the upstanding wall using known injection molding or other construction techniques. It is in this implementation hinged along the side at a hinge point 242. The bottom of the tab 224 has a foot 244 that pivots inward and over a clearance ramp 246 formed in the ledge 228. The lip 232 preloads the tab 224 when the upstanding wall 238 of the trim ring 202 is slid into the opening 206 of the housing 202. The upstanding wall 238 is sized and shaped to slid into the housing 202 without an interference fit, but with minimal clearance so the lip 232 will contact the inside surface of the at least one wall 201 and preload the tab 224. The lip 232 is released from the first and second openings 216, 218 by pressing at the bottom of the tab 224 on the opposite face of the foot-242 244, which causes the tab 224 to pivot about the hinge point 242 and move the lip 232 away from the at least one wall 201.

Ideally the tabs 224 on the trim ring 202 are about 1 inch in width, but this can be varied depending on the application. The openings 216, 218 can be about 0.118 inches (3 mm) in vertical height and about 1 inch wide. Again, these dimensions can be varied for particular applications. While the drawings are not intended to be to scale, they are provided with the components in relative sizes to each other as accurately as possible.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A ventilation fan assembly for mounting in an opening in a wall or ceiling, the wall or ceiling having opposing first and second surfaces, the assembly comprising:

a ventilation fan;

a housing that is sized and shaped to define an interior to house the ventilation fan, the housing further including a sidewall sized and shaped to be received within the opening in the wall or ceiling, the sidewall having a distal end and at least two openings that extend entirely through the sidewall; and a trim ring sized and shaped to be partially slidably received in the interior of the housing, the trim ring having a tab extending from the trim ring at a hinge point, the tab having a first terminal end with a lip extending therefrom that is sized and shaped to be received in the opening in the sidewall, the tab having a second terminal end with a foot formed thereon, and the tab sized and shaped to be biased to urge the lip into one of the at least two openings when the trim ring is partially fit within the interior of the housing;

wherein the sidewall of the housing has the at least two openings in vertical arrangement and that are sized and shaped to releasably engage with the lip on the tab and to accommodate different thicknesses of the wall or ceiling, and wherein the tab is attached to the trim ring at the hinge point that is positioned between the lip and the foot of the tab and configured to pivot about the hinge point and to be biased to engage the lip within a respective one of the at least two openings in the wall of the housing, the tab further configured to pivot and pull the lip out of engagement with the respective one of the at least two openings in response to a force exerted on the foot of the tab.

2. The ventilation fan assembly of claim 1 wherein the lip of the tab is sized and shaped to bear against the housing sidewall in response to sliding of the trim ring into the interior of the housing to preload the tab until the lip is aligned with the opening in the housing sidewall and is urged into the opening in response to the preloading.

3. The ventilation fan assembly of claim 2 wherein the lip has a convex distal surface and an opposing planar bottom surface, the opposing planar bottom surface structured to positively engage an edge of the opening.

4. A system for use in mounting an object in an opening in a structural member, the structural member having opposing first and second surfaces, the system comprising:

a housing having at least one wall that is sized and shaped to define an interior to house the object and that can be received within the opening in the structural member, the housing having at least one flange extending outward therefrom to bear against the first surface of the structural member and support the housing on the structural member, the housing further including at least two tab openings that extend completely through the at least one wall of the housing;

a trim ring having an interior side and an opposing exterior side, the interior side having at least one resilient tab sized and shaped to releasably engage the tab opening in the housing, the trim ring further including at least one second member sized and shaped to bear against the second surface of the structural member when the tab is engaged with one of the at least two tab openings in the housing and thereby hold the trim ring in place on the housing while bearing against the second surface of the structural member;

wherein the at least one wall has an interior face and a distal end, and wherein the trim ring includes a body with a central opening and a flange extending from the body that is sized and shaped to bear against the interior face of the at least one wall adjacent the distal end in slidable engagement with the housing and to have an interference fit with the housing;

wherein the body of the trim ring comprises a ledge that extends from and is substantially orthogonal to the flange and is sized and shaped to bear against the second surface of the structural member when the trim ring is mounted on the housing; and wherein the at least one wall of the housing has the at least two tab openings in vertical arrangement and that are each sized and shaped to releasably engage with a lip on a first end of the tab to accommodate different thicknesses of the structural member, and wherein the tab comprises a foot on a second opposing end of the tab, the tab attached to the trim ring at a hinge point that is positioned between the lip and the foot of the tab, the tab configured to pivot about the hinge point and to be biased to engage the lip within a respective one of the at least two tab openings in the wall of the housing, the tab further configured to pivot and pull the lip out of engagement with the respective one of the at least two tab openings in response to a force exerted on the foot.

5. The system of claim 4, further including a cover having a panel sized and shaped to cover the trim ring, the cover having a connector that releasably connects the cover to the housing, the cover further including at least one standoff extending therefrom that is sized and shaped to bear against the trim ring to hold the trim ring in place.

* * * * *